US007984905B2

(12) United States Patent
Yasumoto

(10) Patent No.: US 7,984,905 B2
(45) Date of Patent: Jul. 26, 2011

(54) SHEET CONVEYING APPARATUS AND IMAGE FORMING APPARATUS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 350 days.

(21) Appl. No.: 12/181,781

(22) Filed: Jul. 29, 2008

(65) Prior Publication Data

US 2009/0033030 A1 Feb. 5, 2009

(30) Foreign Application Priority Data

Jul. 31, 2007 (JP) ..... 2007-199852

(51) Int. Cl.
*B65H 7/02* (2006.01)

(52) U.S. Cl. ..... 271/265.02; 271/227

(58) Field of Classification Search ..... 271/227, 271/228, 255, 265.02
See application file for complete search history.

(56) References Cited

U.S. PATENT DOCUMENTS

| | | | | |
|---|---|---|---|---|
| 4,804,998 | A * | 2/1989 | Miyawaki | 399/21 |
| 5,112,038 | A * | 5/1992 | Dunaway | 271/10.03 |
| 5,437,445 | A * | 8/1995 | Chang et al. | 271/263 |
| 5,471,290 | A * | 11/1995 | Nagayama et al. | 399/371 |
| 6,060,720 | A * | 5/2000 | Gudehus | 250/559.29 |
| 2006/0245769 | A1 | 11/2006 | Mizude et al. | 399/21 |
| 2006/0269337 | A1 | 11/2006 | Yasumoto | 399/388 |
| 2008/0240820 | A1 * | 10/2008 | deJong et al. | 399/395 |
| 2010/0207322 | A1 * | 8/2010 | Yasumoto | 271/228 |

FOREIGN PATENT DOCUMENTS

| | | | |
|---|---|---|---|
| JP | 03238268 | A * | 10/1991 |
| JP | 2000007170 | A * | 1/2000 |
| JP | 2006-306562 | | 11/2006 |
| JP | 2007-4137 | | 1/2007 |
| JP | 2007-31010 | | 2/2007 |

OTHER PUBLICATIONS

Official Letter/Search Report, dated Feb. 25, 2010, issued in Chinese Application No. 200810129446.9.

* cited by examiner

*Primary Examiner* — Stefanos Karmis
*Assistant Examiner* — Howard Sanders
(74) *Attorney, Agent, or Firm* — Fitzpatrick, Cella, Harper & Scinto

(57) ABSTRACT

A first detecting unit S1 for detecting a conveyed sheet at a first detecting position and a second detecting unit S2 for detecting the sheet at a second detecting position are provided. A calculation unit calculates a distance between the first and second detecting positions based on detection signals from the first detecting unit and the second detecting unit at the time when a reference sheet having a known length has been conveyed and a length of reference sheet.

22 Claims, 14 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus.

2. Description of the Related Art

Hitherto, a sheet conveying apparatus for conveying the sheet is provided in each of an offset printing apparatus, a printer using an electrophotographic system or an ink jet system, a copying apparatus, and an image forming apparatus for forming an image at a predetermined position on a facsimile (FAX) sheet.

In such a sheet conveying apparatus, there is a case where high precision is required in a sheet conveying position and a sheet conveying speed. In such a case, various kinds of control such as high precision sheet conveying speed control and feed amount control are necessary. In the sheet conveying apparatus in the related art, control using a plurality of sheet detecting units (sensors) is generally made in many cases. The sheet conveying apparatus which needs such high precision sheet conveying speed control and feed amount control is used in, for example, an inspection system for detecting a specific mark on the sheet (for example, a hologram or the like on a bill).

As an image forming apparatus having such a sheet conveying apparatus which needs the high precision sheet conveying speed control and feed amount control, for example, there is an apparatus having a function for printing images onto both sides of the sheet. According to such an image forming apparatus, in the case of forming the images onto the both sides of the sheet, the recto and verse sides of the sheet in which the image has been formed on the first surface are reversed and the sheet is fed to an image forming unit (image transfer unit).

As a system for reversing the recto and verse sides of the sheet, there is a system using what is called a switch-back system. In the switch-back system, after the sheet passed through a fixing apparatus for fixing the image onto the sheet, the sheet is temporarily pulled in a reverse conveying apparatus and guided to a duplex conveying apparatus. Since the switch-back system has a simple construction as a system for reversing the sheet and is advantageous in terms of a space, it is used as a general system in many cases.

In the switch-back system, a reference of a sheet conveying direction, that is, a leading edge and a trailing edge are exchanged. Therefore, even in the case of an apparatus having a construction in which a skew feed correcting ability of a skew feed roller system is excellent, a positional deviation of the recto and verso images in the sheet conveying direction occurs.

There is a variation of sheet dimensions due to a cutting variation or a fixing heat contraction variation which depends on a fibrous texture. If timing for a toner image and timing for a leading edge of the sheet are merely uniformly matched by using the sheet leading edge as a reference, the position of the recto image and the position of the verso image are deviated. In the case where the positions of the recto and verso images are deviated in this manner, after the images were formed on both sides of the sheet, the images are partially dropped out during a processing step of trimming or folding or, contrarily, a blank is inserted to a next page. Thus, quality of a printed material deteriorates.

To solve such a problem, detecting units (measuring positions) are provided at two positions on a duplex conveying path and a sheet conveying speed and a sheet length are obtained from pass signals of the sheet detecting units (sensors) (refer to Japanese Patent Application Laid-Open No. 2007-004137).

By detecting the length of sheet S which passes, when the image is formed onto the second surface (verse side), even if the leading edge and trailing edge of the sheet are exchanged, a reference edge at the time of forming the image onto the first surface (recto side) can be recognized. Thus, the position of the image formed on the first surface (recto side) can be also recognized. Therefore, by forming the image of the second surface (verse side) so as to be matched with the image position on the first surface, the occurrence of the positional deviation between the recto and verse images can be reduced.

FIG. 15 is a plan view of two detecting units (measuring positions) S1A and S2A provided for the sheet conveying apparatus in the related art as mentioned above. Two sheet detecting sensors SN1 and SN2 are provided for the first detecting unit S1A on the upstream side in the sheet conveying direction so as to be symmetrical around a center C in the lateral direction which perpendicularly crosses the sheet conveying direction on a sheet conveying path (hereinbelow, such a center is referred to as a conveyance center). Likewise, two sheet detecting sensors SN3 and SN4 are provided for the second detecting unit S2A on the downstream side in the sheet conveying direction so as to be symmetrical around the conveyance center C.

When the sheet S which is conveyed in the direction shown by an arrow in the diagram passes through the first and second detecting units S1A and S2A, detection signals illustrated in FIG. 16 are derived from the sheet detecting sensors SN1 to SN4, respectively. In FIG. 16, T1 and T2 denote sheet leading edge detecting times of the sheet detecting sensors SN1 and SN2 of the first detecting unit S1A; T3 and T4 denote sheet leading edge detecting times of the sheet detecting sensors SN3 and SN4 of the second detecting unit S2A; T1' and T2' denote sheet trailing edge detecting times of the sheet detecting sensors SN1 and SN2; and T3' and T4' denote sheet trailing edge detecting times of the sheet detecting sensors SN3 and SN4.

When a time during which the leading edge of the sheet S passes between the sheet detecting sensors SN1 and SN3 is assumed to be f, the time f is calculated as f=T3−T1. When a time during which the leading edge of the sheet S passes between the sheet detecting sensors SN2 and SN4 is assumed to be e, the time e is calculated as e=T4−T2.

When a time during which the trailing edge of the sheet S passes between the sheet detecting sensors SN1 and SN3 is assumed to be h, the time h is calculated as h=T3'−T1'. When a time during which the trailing edge of the sheet S passes between the sheet detecting sensors SN2 and SN4 is assumed to be g, the time g is calculated as g=T4'−T2'.

The sheet conveying speed can be obtained by the passing times obtained as mentioned above and a distance D between the first and second detecting units S1A and S2A. An influence of a conveying roller 5 provided on the upstream side of the first detecting unit S1A and an influence of a conveying roller 6 provided on the downstream side of the second detecting unit S2A are averaged. Therefore, a sheet conveying speed V is calculated by the following equation (1) by using an average value Avg(e, f, g, h) of the above times e to h as a passing time of the distance D.

$$V=D/\mathrm{Avg}(e,f,g,h) \tag{1}$$

Further, when a time during which the whole sheet passes through the sheet detecting sensor SN1 is assumed to be a, the time a is calculated as a=T1'−T1. When a time during which the whole sheet passes through the sheet detecting sensor SN2 is assumed to be b, the time b is calculated as b=T2'−T2. When a time during which the whole sheet passes through the sheet detecting sensor SN3 is assumed to be c, the time c is calculated as c=T3'−T3. When a time during which the whole sheet passes through the sheet detecting sensor SN4 is assumed to be d, the time d is calculated as d=T4'−T4.

Similarly, in order to average those errors, a length L of sheet S is calculated by the following equation (2) by using an average value Avg(a, b, c, d) of the above times a to d as a passing time of the whole sheet.

$$L=V\times\mathrm{Avg}(a,b,c,d) \quad (2)$$

By arranging the two sheet detecting sensors SN1 and SN2 for the first detecting unit S1A and arranging the two sheet detecting sensors SN3 and SN4 for the second detecting unit S2A, that is, by arranging the four sheet detecting sensors in total for them, the length of sheet conveyed at a certain skew feed angle θ can be also measured without providing any special skew feed correcting apparatus.

SUMMARY OF THE INVENTION

When the sheet S is conveyed at a certain skew feed angle θ, however, since the sheet length obtained by the equation (2) is equal to a distance L' which has obliquely been measured at the conveyance center C, it differs from the accurate sheet length L (FIG. 17).

When the sheet S is obliquely fed as mentioned above, a deviation (T2−T1) of the detection timing of the detection signals illustrated in FIG. 18 occurs between the sheet detecting sensors SN1 and SN2. If the deviation of the detection timing in the sheet detecting sensors SN1 and SN2 occurred as mentioned above, it is determined that the sheet S was obliquely fed, and the sheet length is corrected.

The deviation of the detection timing in the sheet detecting sensors SN1 and SN2 can be calculated as a distance based on a product V(T2−T1) of the sheet conveying speed V obtained by the above equation (1) and (T2−T1). That is, if a distance d between SN1 and SN2 has already been known, the skew feed angle θ is calculated by the following equation (3).

$$\theta=\tan^{-1}\{V(T2-T1)/d\} \quad (3)$$

The sheet length L can be corrected to L' cos θ by the skew feed angle θ obtained as mentioned above.

However, in the sheet conveying apparatus in the related art, D included in the equation (1), that is, the distance D between the first and second detecting units S1A and S2A in FIG. 15 varies due to a mechanical tolerance of parts which support the four sheet detecting sensors SN1 to SN4. Further, the distance D also varies due to a mechanical tolerance accumulation of a plurality of parts regarding a construction of the sheet conveying path.

An influence which is exerted on a detection result of the sheet length L by the variation in the distance D is now exemplarily estimated. Even if it is presumed that the distance D slightly differs from a nominal dimension by 0.1 mm, a detection error of about 0.69 mm occurs in the case of the A3 size (420 mm). The longer the length of sheet S in the sheet conveying direction is, the average time Avg(a, b, c, d) in the equation (2) becomes longer. Therefore, the longer the length of sheet S in the sheet conveying direction is, the larger error occurs. Although size dependency does not inherently exist in the equations (1) and (2), such size dependency that the detection error increases with an increase in size also appears due to such an influence of the error accumulation.

An inherent object of detecting the sheet length L is to recognize the position of the image transferred onto the first surface (recto side) based on information of the sheet length L and to accurately control the image forming position on the second surface (verso side) according to such a position. Therefore, as a level which is actually required at least in the printed material, the positional deviation amount of the recto and verso images of 0.5 mm or less and the variation of ±0.3 mm or less are proper values.

From the above result, it will be understood that even if the distance D between the first and second detecting units S1A and S2A differs merely by 0.1 mm, the influence which is exercised on the image quality is sufficiently large.

The following countermeasures are, therefore, considered to manage a value of the distance D between the first and second detecting units S1A and S2A.

(1) The mechanical tolerance of the parts is set to be severe.

(2) The distance D is measured by using a measuring instrument.

(3) The system is constructed so that the distance D can be adjusted and the distance D is adjusted by using a tool.

However, there is a limitation in the method of (1). As for the countermeasure of (2), it takes very large troublesomeness and costs for measurement. Furthermore, in the case of presuming a mass production, it becomes a large obstacle. As for the countermeasure of (3), since the construction becomes complicated in association with the adjustment type, a large increase in costs is inevitable. Above all, according to the countermeasures of (2) and (3), if it is necessary to replace a sensor unit at the market due to an accidental failure of the sheet detecting sensor, it is very difficult to cope with such a situation.

That is, according to the construction in the related art, the various kinds of control of the sheet are made based on the sheet conveying speed, sheet length, and the like which have been detected every sheet. The sheet conveying speed and the sheet length of the sheet are detected based on the distance D between the first and second detecting units S1A and S2A. As mentioned above, there is a risk where the distance D between the first and second detecting units S1A and S2A varies. There is, consequently, such a problem that the various kinds of control at the time of conveying the sheet cannot be made at high precision.

The invention is, therefore, made in consideration of such a present situation and it is an object of the invention to provide a sheet conveying apparatus in which a sheet conveying speed and a length of a sheet can be precisely detected.

According to the invention, there is provided a sheet conveying apparatus comprising: a first detecting unit that detects a conveyed sheet at a first detecting position; a second detecting unit that detects the conveyed sheet at a second detecting position provided on a downstream side in a sheet conveying direction of the first detecting position; a calculation unit that calculates a distance between the first detecting position and the second detecting position based on detection signals from the first detecting unit and the second detecting unit at the time when a reference sheet having a known length in the sheet conveying direction is conveyed and a length of the reference sheet.

By calculating the distance between the detecting positions based on the detection signals at the time when the reference sheet whose length in the sheet conveying direction has already been known is detected, the sheet length or the sheet conveying speed can be more precisely detected.

Further features of the present invention will become apparent from the following description of exemplary embodiments with reference to the attached drawings.

DESCRIPTION OF THE EMBODIMENTS

Exemplary embodiments for carrying out the invention will be described hereinbelow in detail with reference to the drawings.

Figure 1:
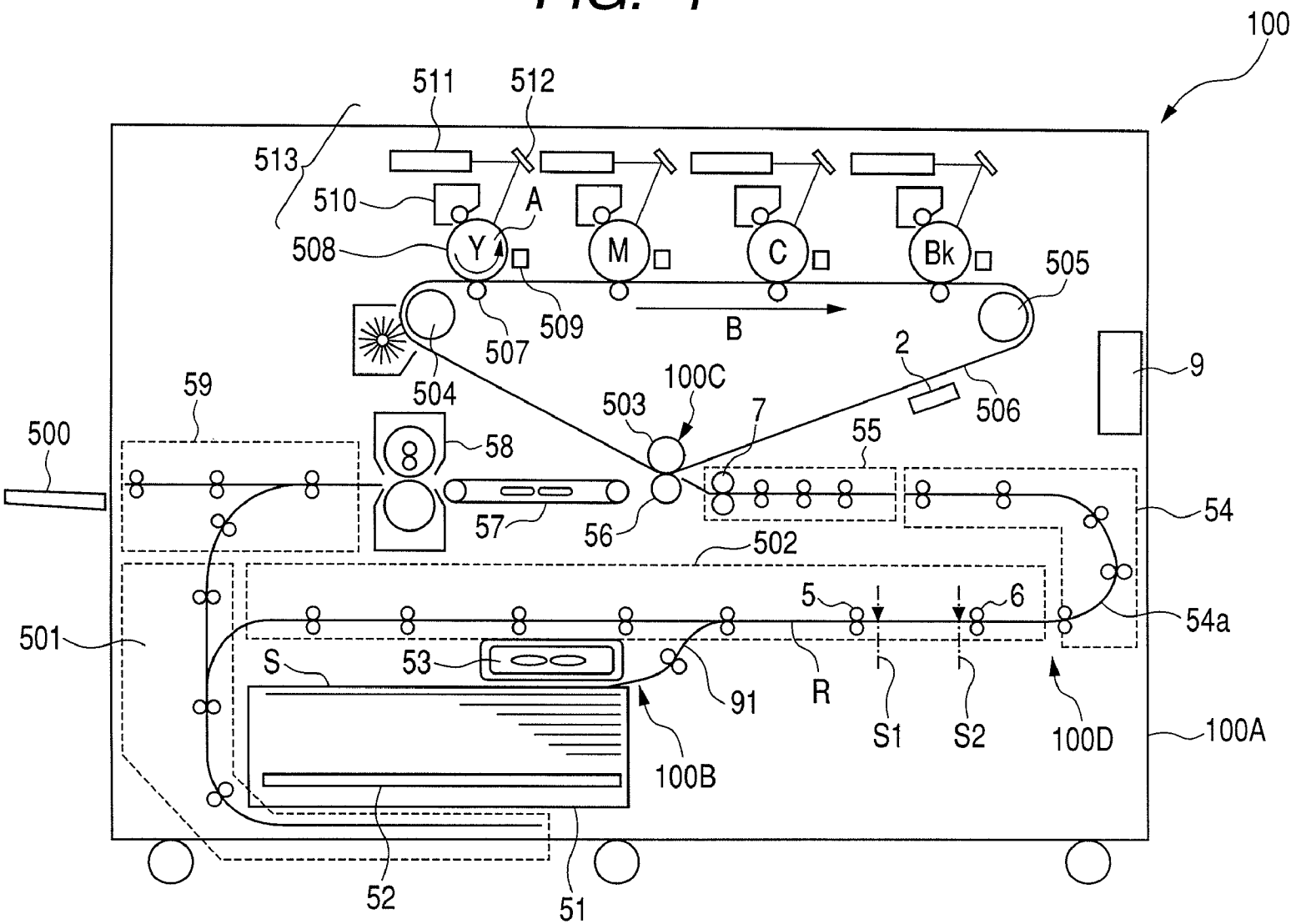
FIG. 1 is a diagram illustrating a schematic construction of a color image forming apparatus as an example of an image forming apparatus having a sheet conveying apparatus according to the first embodiment of the invention.

FIG. 1 is a diagram illustrating a schematic construction of a color image forming apparatus as an example of an image forming apparatus having a sheet conveying apparatus according to the first embodiment of the invention.

In FIG. 1, a color image forming apparatus 100 has a color image forming apparatus main body 100A (hereinbelow, referred to as an apparatus main body). In view of a construction, the color image forming apparatus 100 is mainly classified into: a tandem system in which a plurality of image forming units is arranged in line; and a rotary system in which a plurality of image forming units is arranged in a cylindrical shape. A transfer system is classified into: a direct transfer system in which a toner image is directly transferred onto the sheet from a photosensitive drum; and an intermediate transfer system in which after the toner image was temporarily transferred onto an intermediate transfer material, it is transferred onto a sheet material.

According to the intermediate transfer system, since the operation in which the sheet is held on a transfer belt like a direct transfer system is unnecessary, it can cope with a variety of many sheets such as super-thick paper and coated paper. Since the intermediate transfer system has such features that parallel processes are executed in the plurality of image forming units and a full-color image is transferred in a lump, it is suitable for realization of a mass production. The color image forming apparatus 100 according to the embodiment is of the intermediate transfer tandem system in which image forming units of four colors are arranged on an intermediate transfer belt in a line.

The apparatus main body 100A has: an image forming unit 513; a sheet feeding unit 100B for conveying the sheet S; and a transfer unit 100C for transferring a toner image formed by the image forming unit 513 onto the sheet S fed by the sheet feeding unit 100B. The apparatus main body 100A also has a sheet conveying apparatus 100D for conveying the sheet.

The image forming unit 513 has image forming units of yellow (Y), magenta (M), cyan (C), and black (Bk). Each of the image forming units has: a photosensitive drum 508; an exposing apparatus 511; a developing unit 510; a primary transfer apparatus 507; and a cleaner 509. Colors of images which are formed by the image forming units are not limited to those four colors and layout order of the colors is not limited to the above order either.

The sheet feeding unit 100B has: a sheet enclosing portion 51; and a sheet feeding unit 53. The sheet enclosing portion 51 encloses the sheets S in such a form that they are stacked onto a lift-up device 52. The sheet feeding unit 53 feeds out the sheets S enclosed in the sheet enclosing portion 51. As a sheet feeding unit 53, a system using a frictional separation by a feed roller or a system using a separation adsorption by the air can be mentioned. In the embodiment, the sheet feeding system by the air is mentioned as an example.

The transfer unit 100C has an intermediate transfer belt 506 which is suspended by rollers such as driving roller 504, tension roller 505, and secondary transfer inner roller 503 and is conveyed and driven in the direction shown by an arrow B in the diagram.

The toner image formed on the photosensitive drum is transferred onto the intermediate transfer belt 506 by a predetermined pressing force and an electrostatic load bias which are applied from the primary transfer apparatus 507. The intermediate transfer belt 506 applies the predetermined pressing force and the electrostatic load bias in a secondary transfer unit formed by the secondary transfer inner roller 503 and a secondary transfer outer roller 56 which almost face each other, thereby allowing an un-fixed image to be adsorbed onto the sheet S.

The sheet conveying apparatus 100D has: a conveying unit 54; a skew feed correcting apparatus 55 which has a registration roller 7 and constructs a skew feed correcting unit; a pre-fixing conveying unit 57; a branch conveying apparatus 59; a reverse conveying apparatus 501; and a duplex conveying apparatus 502.

When the image is formed onto the sheet, first, the photosensitive drum 508 is rotated in the direction shown by an arrow A in the diagram and the surface of the photosensitive drum is preliminarily and uniformly charged by a charging unit (not shown).

After that, based on a signal of transmitted image information, the exposing apparatus 511 emits light onto the photosensitive drum 508 which is rotating. By irradiating the emitted light properly through a reflecting unit 512, a latent image is formed onto the photosensitive drum 508. A small quantity of transfer residual toner remaining on the photosensitive drum 508 is collected by a cleaner 509 and used again to form a next image.

The electrostatic latent image formed on the photosensitive drum 508 is toner-developed by the developing apparatus 510, so that the toner image is formed onto the photosensitive drum. After that, the predetermined pressing force and the electrostatic load bias are applied by the primary transfer apparatus 507 and the toner image is transferred onto the intermediate transfer belt 506.

Each of the image forming units of Y, M, C, and Bk in the image forming unit 513 sequentially forms the image and overlays the toner image onto the toner image on the upstream which has primarily been transferred onto the intermediate transfer belt at predetermined timing. Thus, the full-color toner image is finally formed on the intermediate transfer belt 506.

The sheet S passes through a conveying path 91 and is fed to a conveying path R forming a sheet conveying path by the sheet feeding unit 53 synchronously with the image forming timing of the image forming unit 513. After that, the sheet S passes through a conveying path 54*a* provided for the conveying unit 54 and is conveyed to the skew feed correcting apparatus 55.

The skew feed correcting apparatus 55 corrects a positional deviation and a skew feed of the sheet S which is being conveyed. After that, the sheet S is conveyed to the registration roller 7. Conveying timing of the sheet is corrected by the registration roller 7 and the sheet is conveyed to the secondary transfer unit formed by the secondary transfer inner roller 503 and the secondary transfer outer roller 56. After that, the full-color toner image is secondarily transferred onto the sheet S by the secondary transfer unit.

The sheet S on which the toner image has secondarily been transferred is conveyed to a fixing apparatus 58 by the prefixing conveying unit 57. The fixing apparatus 58 applies a predetermined pressing force generated by the rollers which almost face each other or the belt and a heating effect obtained generally by a heat source of a heater, thereby fusing and fixing the toner onto the sheet S.

The sheet S having the fixed image is ejected as it is onto a discharge tray 500 by the branch conveying apparatus 59. In the case of forming the images onto both sides of the sheet S, the sheet S is conveyed to the reverse conveying apparatus 501 by a change-over of a flapper (not shown).

When the sheet S is conveyed to the reverse conveying apparatus 501 in order to form the images onto the both sides, by executing the switch-back operation, the leading and trailing edges of the sheet S are exchanged and the sheet is conveyed to the conveying path R provided for the duplex conveying apparatus 502. After that, the sheet is sent to the secondary transfer unit synchronously with timing of a sheet of a subsequent job which is fed from the sheet feeding unit 100B. Since an image forming process at the time of forming the image onto the second surface (verso side) is similar to that of the first surface, its description is omitted here.

A number of conveying rollers are arranged for each of the conveying unit 54, branch conveying apparatus 59, reverse conveying apparatus 501, and duplex conveying apparatus 502. Those conveying rollers are constructed in such a manner that in a state where the sheet is sandwiched between a driving roller and a driven roller, the driving roller and the driven roller rotate, thereby conveying the sheet. According to those conveying rollers, by urging the driven roller to the driving roller side by an urging member of a spring (not shown), a pressure adapted to nip the sheet is set between both of those rollers.

Figure 2:
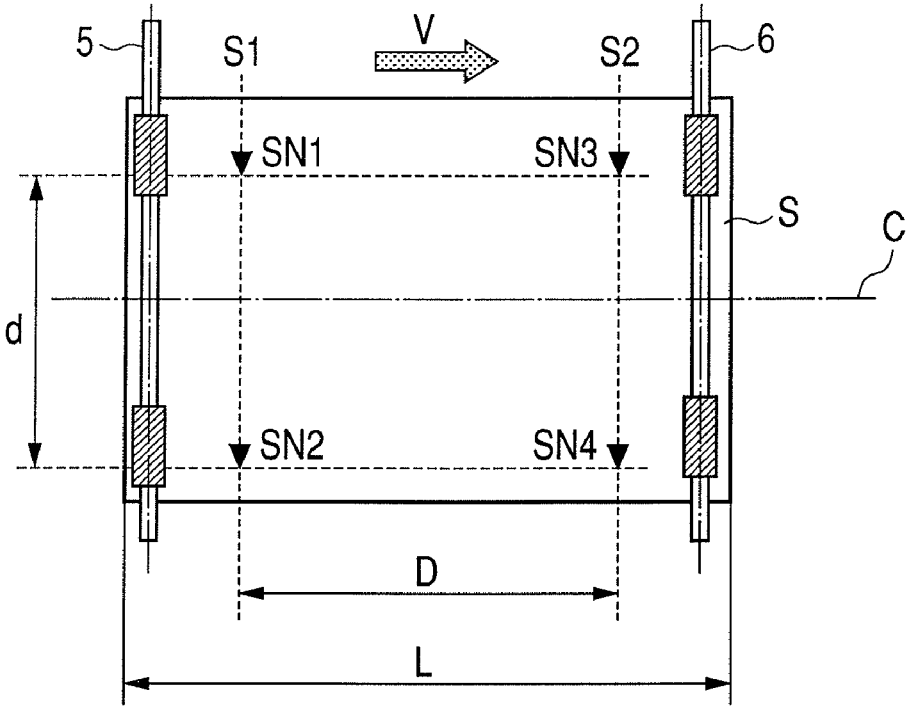
FIG. 2 is a plan view of two detecting units provided for the sheet conveying apparatus.

In FIG. 1, detecting units (detecting positions) S1 and S2 are provided on the conveying path R. As illustrated in FIG. 2, a plurality of, in the embodiment, the two sheet detecting sensors SN1 and SN2 are arranged for the first detecting unit S1 on the upstream side in the sheet conveying direction so as to be symmetrical around the conveyance center C. A plurality of, in the embodiment, the two sheet detecting sensors SN3 and SN4 are arranged for the second detecting unit S2 on the downstream side in the sheet conveying direction so as to be symmetrical around the conveyance center C.

The first and second detecting units S1 and S2 are arranged so as to be away from each other at the distance D in the sheet conveying direction. With respect to the lateral direction, the sheet detecting sensors SN1 and SN3 on the rear side are arranged symmetrical around the conveyance center C so as to be away from each other at an interval d, and the sheet detecting sensors SN2 and SN4 on this side are similarly arranged symmetrical around the conveyance center C so as to be away from each other at the interval d.

In the embodiment, the sheet detecting sensors SN1 to SN4 are formed by optical sensors. By using the optical sensors as mentioned above, the passing timing of the sheet S can be detected in a contactless manner, thereby preventing an influence of a conveyance resistance or the like from being exerted on the detection signals.

In FIG. 2, the conveying roller 5 is provided on the upstream side of the first detecting unit S1 and the conveying roller 6 is provided on the downstream side of the second detecting unit S2, respectively.

If a rubber roller is used as a conveying roller, generally, a change in outer diameter due to a temperature and moisture is equal to about a few μm/° C. According to the rubber roller, even if a coefficient of friction is high, when a speed difference occurs between the conveying rollers in the upstream and downstream, a stick slip is liable to occur.

Therefore, when a high conveying precision is required, it is desirable to use a blast roller obtained by blast-processing the surface of a metal (for example, SUS) in place of the rubber roller. For this purpose, in the embodiment, blast rollers are used as conveying rollers 5 and 6 for conveying the sheet when it passes through the sheet detecting sensors SN1 to SN4.

By using the blast-processed conveying rollers 5 and 6, it is possible to make it difficult to receive an influence of an environmental fluctuation such as temperature or moisture, a speed difference between the conveying rollers 5 and 6 and other conveying rollers locating on the upstream and downstream sides, or the like. The detecting precision of the sheet detecting sensors SN1 to SN4 can be improved.

The distance D between the first detecting unit S1 (first detecting position) and the second detecting unit S2 (second detecting position) is mechanically determined by a component part which supports each of the sheet detecting sensors SN1 to SN4. Therefore, the distance D has a variation within a range of tolerance of the part. If each of the sheet detecting sensors is supported by a plurality of component parts, the distance D becomes a distance in which the tolerance of the component parts are accumulated.

Therefore, in the embodiment, a value of the distance D between the first detecting unit S1 and the second detecting unit S2 which differs every color image forming apparatus 100 is calculated. By calculating the value of the distance D between the first and second detecting units S1 and S2, a reference distance serving as information such as sheet conveying speed, sheet length, and the like which become a base at the time of making various kinds of controls such as sheet position control can be accurately arithmetically operated.

Subsequently, such a calculating method of the reference distance of the first and second detecting units S1 and S2 will be described.

The color image forming apparatus 100 according to the embodiment has an adjusting mode for calculating the reference distance between the first detecting unit S1 and the second detecting unit S2 (distance between the reference detecting positions). The adjusting mode can be selected from a display screen of an operating unit.

When the adjusting mode is selected by the operating unit, a reference sheet is fed out toward the first and second detecting units S1 and S2 from the sheet feeding unit 100B. The first and second detecting units S1 and S2 detect passing timing of the reference sheet just after the sheet was joined from the conveying path 91. By detecting the passing timing just after the joint as mentioned above, the contraction change of the reference sheet accompanied with the passage of the fixing apparatus 58 is excluded and arithmetic operating precision of the reference distance can be improved.

The length of reference sheet which is fed out has already been known. The length information of the reference sheet S whose length has already been known is input to the operating unit. As a reference sheet S, specifically speaking, a sheet such as a tool sheet whose length is managed and which is difficult to be contracted due to the temperature and moisture is used. Or, it is possible to use a method whereby an ordinary sheet is used as a reference sheet, a length in the conveying direction of the sheet is accurately measured by a scale just before the adjusting mode is executed, and the measured length is input to the operating unit. Or, if a media brand sheet whose cutting precision and contraction fluctuation are excellent is experientially designated as a reference sheet, the measurement can be omitted and the sheet can be also applied at a nominal size. In the case of using the tool sheet, a sequence for stopping the tool sheet in the conveying path before the sheet enters the fixing apparatus 58 may be provided in the adjusting mode.

Based on any one of the above methods, the known length L of the reference sheet is input from the display screen of the operating unit and the sheet feeding operation is started. When the sheet feeding operation is started, detection signals as illustrated in FIG. 3 are derived from the sheet detecting sensors SN1 to SN4.

Figure 3:
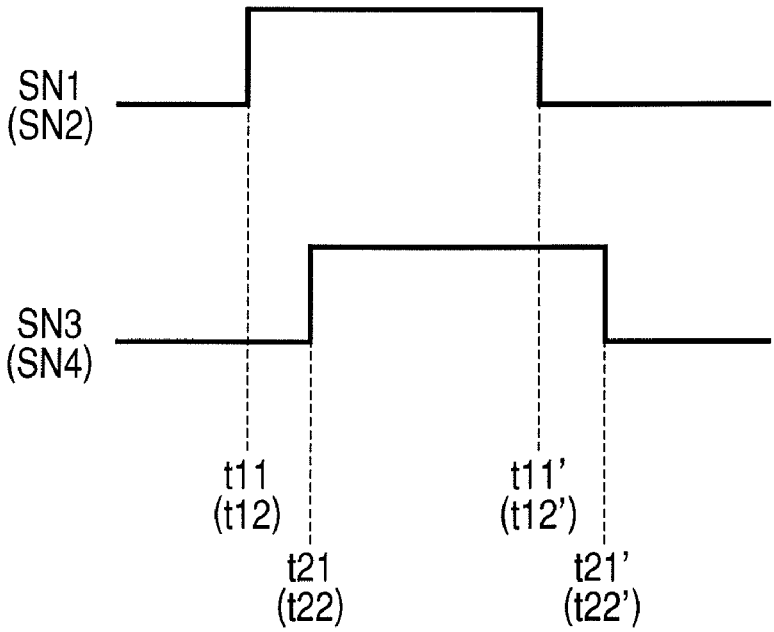
FIG. 3 is a diagram illustrating detection signals from four sheet detecting sensors provided for the two detecting units.

In FIG. 3, t11 denotes a time when a leading edge of the reference sheet has passed through the sheet detecting sensor SN1 of the first detecting unit S1, t12 denotes a time when the leading edge of the reference sheet has passed through the sheet detecting sensor SN2 of the first detecting unit S1, t11' denotes a time when a trailing edge of the reference sheet has passed through the sheet detecting sensor SN1, and t12' denotes a time when the trailing edge of the reference sheet has passed through the sheet detecting sensor SN2, respectively.

t21 denotes a time when a leading edge of the reference sheet has passed through the sheet detecting sensor SN3 of the second detecting unit S2, t22 denotes a time when the leading edge of the reference sheet has passed through the sheet detecting sensor SN4 of the second detecting unit S2, t21' denotes a time when a trailing edge of the reference sheet S has passed through the sheet detecting sensor SN3, and t22' denotes a time when the trailing edge of the reference sheet S has passed through the sheet detecting sensor SN4, respectively.

An average value of t11 and t12, that is, the leading edge passing time of the first detecting unit S1 is assumed to be t1. An average value of t21 and t22, that is, the leading edge passing time of the second detecting unit S2 is assumed to be t2. Further, an average value of t11' and t12', that is, the trailing edge passing time of the first detecting unit S1 is assumed to be t1'. An average value of t21' and t22', that is, the trailing edge passing time of the second detecting unit S2 is assumed to be t2'.

Thus, the timing when the leading edge of the reference sheet passes through the first detecting unit S1 and the second detecting unit S2 and the timing when the trailing edge of the reference sheet passes through the first detecting unit S1 and the second detecting unit S2 can be replaced by the value of the conveyance center C which is most difficult to be influenced by the skew.

Further, a difference (t1'−t1) in the sensor signals at the time when the reference sheet having the known length L has passed through the first and second detecting units S1 and S2 is assumed to be α. Likewise, (t2'−t2) is assumed to be β, (t2−t1) is assumed to be γ, and (t2'−t1") is assumed to be η. An average value of α and β, that is, an average time during which the whole reference sheet passes through the first and second detecting units S1 and S2 is assumed to be Avg(α, β). An average time during which the reference sheet passes through the distance D between the first and second detecting units S1 and S2 is assumed to be Avg(γ, η).

The sheet conveying speed V can be obtained by $$V=L/\mathrm{Avg}(\alpha,\beta)$$

The conveying speed V of the reference sheet is equal to the conveying speed at the time when the reference sheet is conveyed by the distance D. Therefore, a reference distance D can be calculated by the obtained conveying speed V of the reference sheet and Avg(γ, η).

In other words, with respect to the sheet conveying speed V, since a relation of [the conveying speed at the time when the reference sheet passes through the distance D]=[the conveying speed at the time when the reference sheet passes through the reference sheet length (whole length) L] ought to be satisfied, the following equation (4) is satisfied.

$$D/\mathrm{Avg}(\gamma,\eta)=L/\mathrm{Avg}(\alpha,\beta) \quad (4)$$

Thus, the reference distance D between the first and second detecting units S1 and S2 is obtained by the following equation (5).

$$D=L\times\mathrm{Avg}(\gamma,\eta)/\mathrm{Avg}(\alpha,\beta) \quad (5)$$

Therefore, the reference distance D is calculated from the equation (5).

Figure 4:
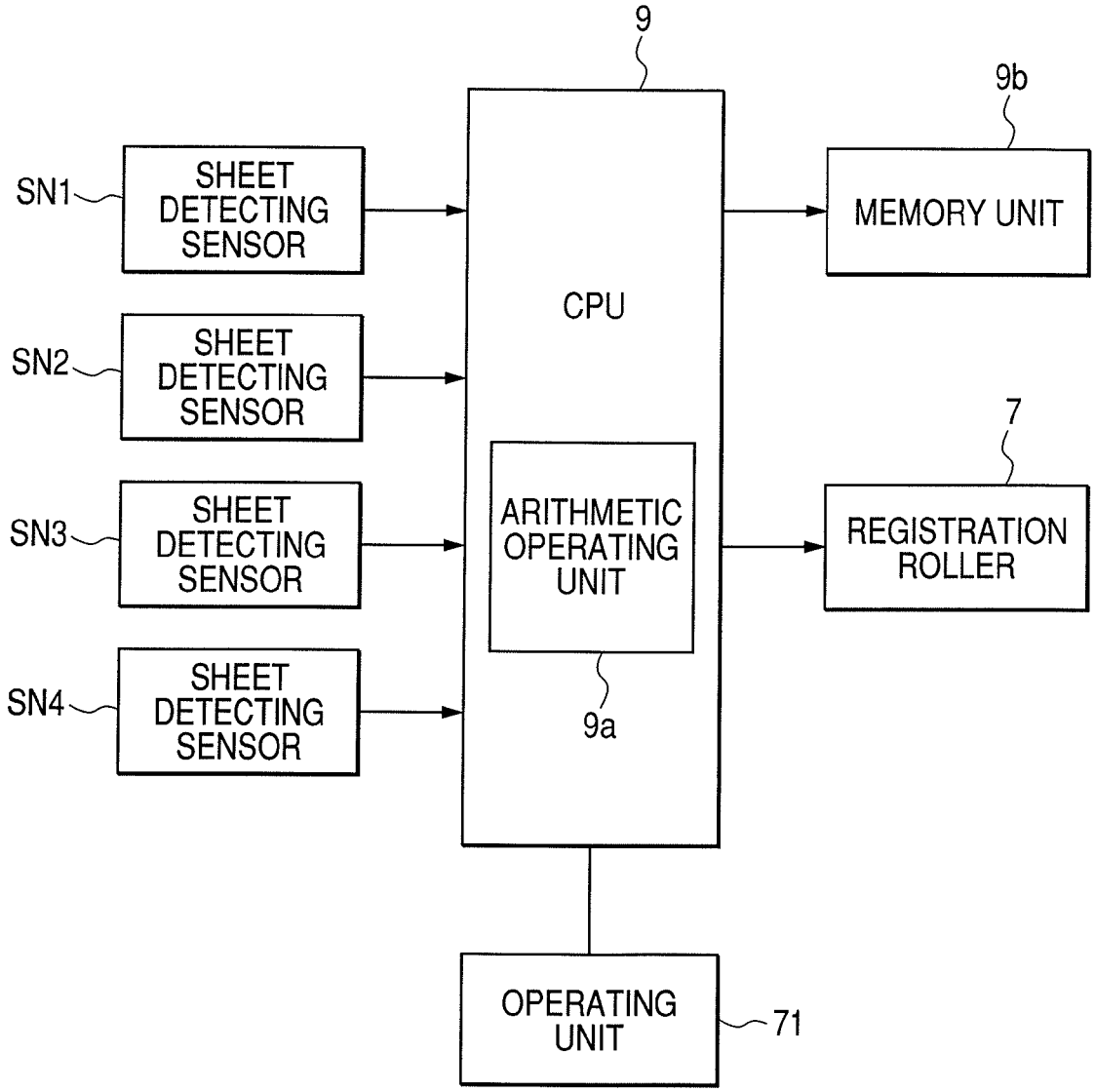
FIG. 4 is a control block diagram of the color image forming apparatus.

FIG. 4 is a control block diagram of the color image forming apparatus 100. In FIG. 4, a CPU (control unit) 9 is arranged at a predetermined position (refer to FIG. 1) of the apparatus main body 100A. The detection signals from the sheet detecting sensors SN1 to SN4 are input to the CPU 9. The operating unit (a setting unit) 71 is connected to the CPU 9. An information setting on the operating unit 71 is input to the CPU 9.

The CPU 9 has an arithmetic operating unit (calculation unit) 9*a*. The arithmetic operating unit 9*a* arithmetically calculates the values of α, β, γ, and η by the detection signals from the sheet detecting sensors SN1 to SN4 and arithmetically calculates the reference distance D between the first and second detecting units S1 and S2 based on the calculated α, β, γ, and η. Further, the CPU 9 stores and backs up the calculated reference distance D between the first and second detecting units S1 and S2 into a memory unit 9*b* as an inherent value of each color image forming apparatus 100.

Arithmetic operations which are subsequently executed when the sheet conveying speed and the sheet length are detected are executed by reading out the value of the reference distance between the first and second detecting units S1 and S2 which was calculated in the adjusting mode and has been stored in the memory unit 9*b*. By having such an adjusting mode, the initial adjusting work upon assembling of the color image forming apparatus 100 or the re-adjusting work in the case where an accidental sensor failure or the like occurred at the market can be easily executed.

Further, in the case of calculating the equation (5), it is sufficient that an absolute value itself of the sheet conveying speed V is obscure. That is, although there are various durability degrees of the apparatus at the time of the replacement of the sensor unit at the market, in the equation (5), the reference distance D can be calculated only from the equation relation between the two sheet conveying speeds irrespective of the absolute value of the sheet conveying speed V. Therefore, it is also unnecessary for the user to worry about a durability change of the conveying rollers.

Figure 17:
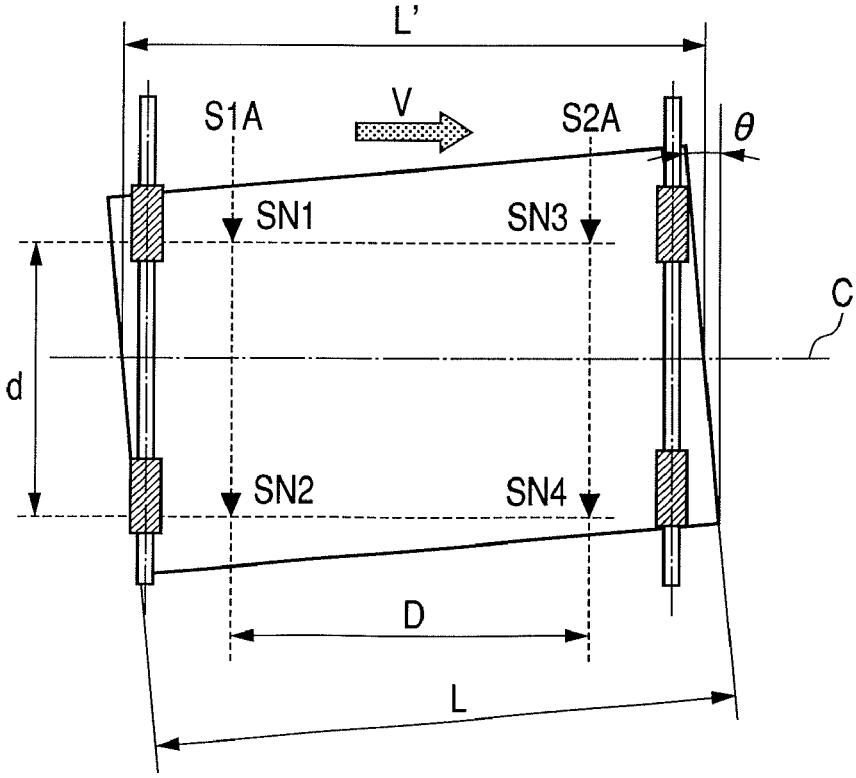
FIG. 17 is a diagram for describing correction of a length of a skew feed sheet using the four sheet detecting sensors provided for the two detecting units.
Figure 18:
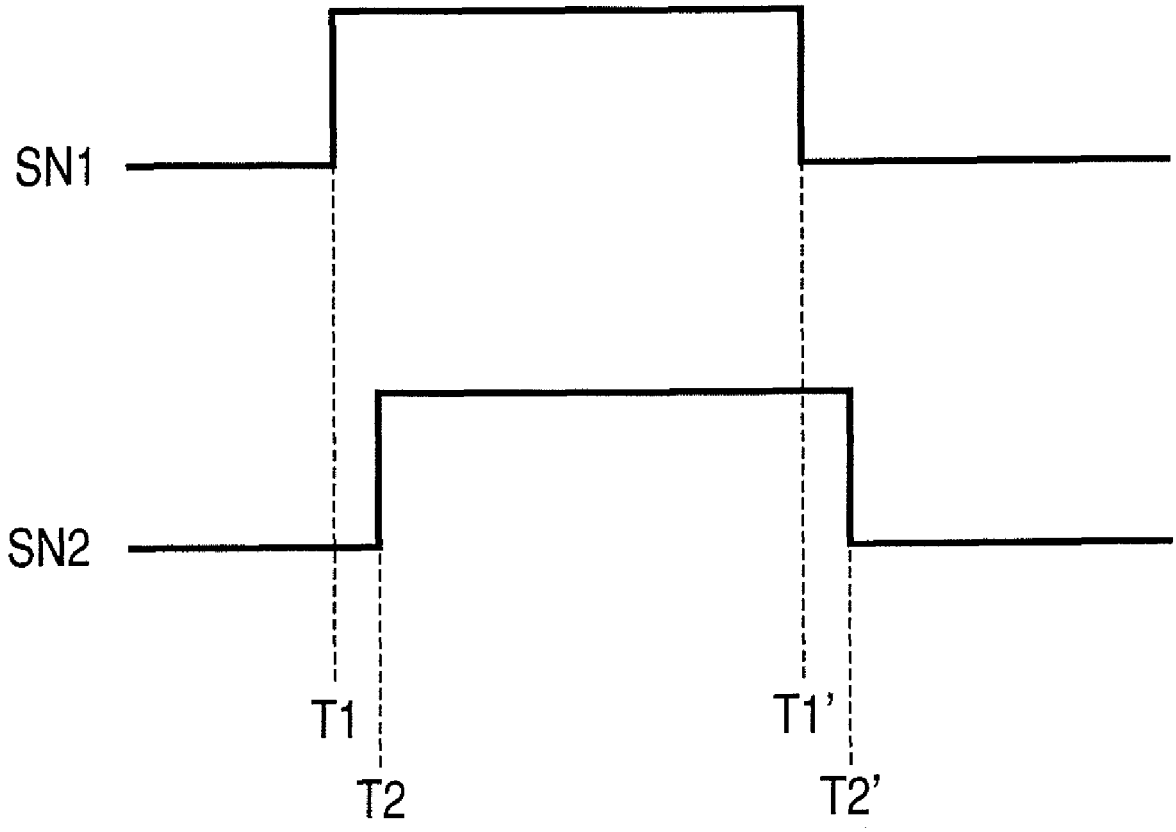
FIG. 18 is a diagram illustrating the detection signals from the four sheet detecting sensors provided for the two detecting units at the time when the sheet has obliquely been fed.

Further, in the case of using the four sheet detecting sensors SN1 to SN4 as in the embodiment, even if any special skew feed correcting apparatus is not provided, the error due to the skew feed angle θ can be corrected as illustrated in FIG. 17 already mentioned above. Thus, merely by passing the sheet S, the reference distance can be accurately and easily obtained from the equation (5) and since the parts regarding the skew feed correcting apparatus are unnecessary, the costs can be reduced.

By using the four sheet detecting sensors SN1 to SN4 as in the embodiment, the skew feed angle θ can be detected in each of the first and second detecting units S1 and S2. That is, by using the four sheet detecting sensors SN1 to SN4, the skew feed amount of the sheet can be detected based on the detection signals which are derived when the leading edge of the sheet enters the first detecting unit S1 and when it enters the second detecting unit S2. Further, the skew feed amount of the sheet can be detected based on the detection signals which are derived when the trailing edge of the sheet exits from the first detecting unit S1 and when it exits from the second detecting unit S2. Consequently, an influence of the micro change in skew occurring upon conveyance can be also averaged.

Figure 5:
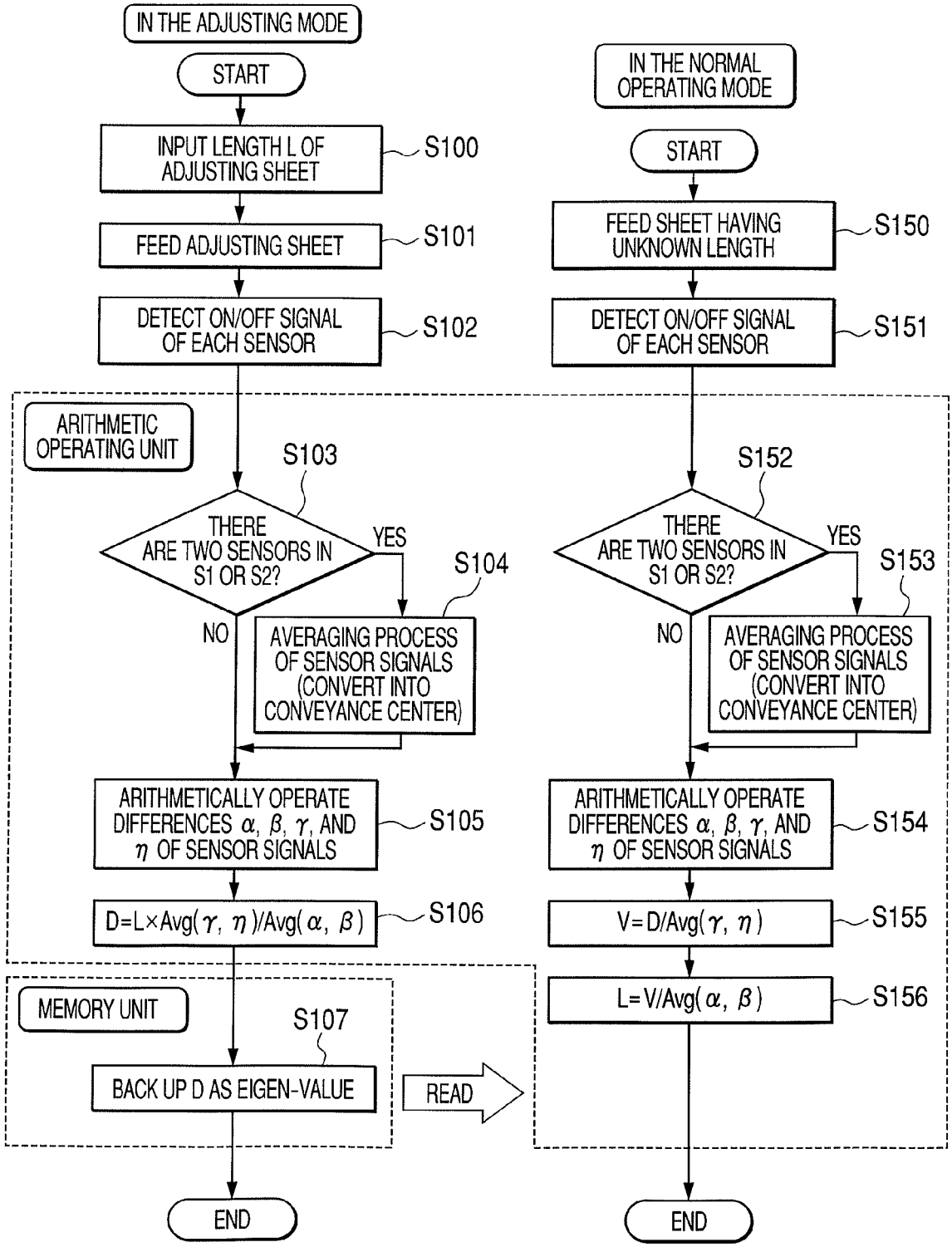
FIG. 5 is a flowchart illustrating the operations in an adjusting mode and a normal operating mode in the color image forming apparatus.

FIG. 5 is a flowchart illustrating the operations in the adjusting mode and the normal operating mode in the color image forming apparatus 100 according to the embodiment.

In the embodiment, in the case of the adjusting mode, first, the length of adjusting sheet is input from the display screen of the operating unit 71 as already mentioned above (S100). The reference sheet for adjustment is fed (S101). After that, the CPU 9 detects ON/OFF signals from the sheet detecting sensors SN1 to SN4 (S102).

Subsequently, the CPU 9 discriminates in which one of the first and second detecting units S1 and S2 the two sensors exist (S103). In the embodiment, the two sensors are provided for each of the first and second detecting units S1 and S2 (Y (YES) in S103). Therefore, based on the ON/OFF signals from the sheet detecting sensors SN1 to SN4, the arithmetic operating unit 9*a* of the CPU 9 executes a process for averaging the sheet leading edge passing times and the sheet trailing edge passing times of the first detecting unit S1 and the second detecting unit S2 (S104).

After that, the arithmetic operating unit 9*a* calculates the differences α, β, γ, and η of the sensor signals so as to convert the sheet leading edge passing times and the sheet trailing edge passing times into the conveyance center (S105). The arithmetic operating unit 9*a* calculates the reference distance D by the equation (5) [$D=L\times Avg(\gamma,\eta)/Avg(\alpha,\beta)$] (S106). Subsequently, the CPU 9 allows the memory unit 9*b* to store the reference distance D as an inherent value (S107).

In the normal operating mode, a sheet whose length is unknown is fed (S150). Subsequently, the CPU 9 detects the ON/OFF signals from the sheet detecting sensors SN1 to SN4 (S151). After that, the CPU 9 discriminates in which one of the first and second detecting units S1 and S2 the two sensors exist (S152).

In the embodiment, since the two sensors are provided for each of the first and second detecting units S1 and S2 (Y (YES) in S152), the CPU 9 executes a process for averaging the ON/OFF signals from the sheet detecting sensors SN1 to SN4 (S153). Thus, the sheet leading edge passing time and the sheet trailing edge passing time of the first detecting unit S1 and the sheet leading edge passing time and the sheet trailing edge passing time of the second detecting unit S2 are converted into the time at the conveyance center C at which it is most difficult to receive the influence of the skew.

The arithmetic operating unit 9*a* calculates the differences α, β, γ, and η of the sensor signals (S154). By using the reference distance D stored in the memory unit 9*b*, the arithmetic operating unit 9*a* calculates the sheet conveying speed V in a real-time manner by an equation according to the foregoing equation (1) [$V=D/Avg(\gamma,\eta)$] (S155).

The arithmetic operating unit 9*a* also calculates the length L of sheet S by an equation [$L=V/Avg(\alpha,\beta)$] according to the foregoing equation (2) (S156). By calculating and using the unknown length L of sheet by the arithmetic operating unit 9*a* as mentioned above, even in the case of the switch-back in which the leading and trailing edges of the sheet are exchanged in the reverse conveying apparatus 501, the image forming references (transfer references) of the images of the recto and verso sides for the sheet can be unified.

Thus, since the position of the image which has been transferred to the first surface (recto side) can be known from the information of the sheet length, the CPU 9 can adjust the image forming position on the second surface (verso side) by controlling deceleration timing of the registration roller 7 according to the obtained image position.

If only the deceleration timing of the registration roller 7 is controlled, it is sufficient that the detection by the sheet detecting sensors SN1 to SN4 is executed only at the time of the duplex passage of the second surface. In the embodiment, such a detection is also executed at the time of the passage of the first surface of the sheet fed out of the feeding apparatus. Therefore, also with respect to the contraction change ratio accompanied by the passage of the fixing apparatus 58, it can be further fed back in a form of magnification control of the image of the second surface.

As mentioned above, the arithmetic operating unit 9*a* calculates the reference distance between the first and second detecting units based on the detection signals of the reference sheet having the known length and the length of reference sheet. The calculated distance is stored as a reference distance in the memory unit 9*b*. Thus, the various kinds of control at the time of conveying the sheet S can be certainly made.

The information of the distance between the detecting positions such as sheet conveying speed, sheet length, or the like which varies and differs every apparatus body as mentioned above and becomes the base at the time of making each conveyance control of the sheet can be accurately obtained. Therefore, in the embodiment, the technique regarding the image position precision of the recto and verso sides provides a desired effect and can improve the quality of the printed material. Further, the adjustment can be easily made not only upon assembling but also upon replacement of the sensor unit at the market accompanied by the accidental sensor failure or the like.

In the embodiment, the arithmetic operation of the reference distance D is executed by using all of $\alpha$, $\beta$, $\gamma$, and $\eta$ as shown in the equation (5). However, the reference distance D can be also obtained by using only the time ($\gamma$ or $\eta$) when either the leading edge or the trailing edge of the sheet passes through the distance D or the time ($\alpha$ or $\beta$) when the whole sheet passes through either the first detecting unit S1 or the second detecting unit S2.

Although the color image forming apparatus 100 illustrated in FIG. 1 is assumed to be the color image forming apparatus of the tandem construction, a method and a construction regarding the image creation are not limited so long as the apparatus 100 is an image forming apparatus in which the image position precision of the recto and verso sides is similarly required.

The second embodiment of the invention will now be described.

Although the above first embodiment has been described with respect to the construction using the four sheet detecting sensors, in the second embodiment, the reference distance is obtained by three sheet detecting sensors.

Figure 6A:
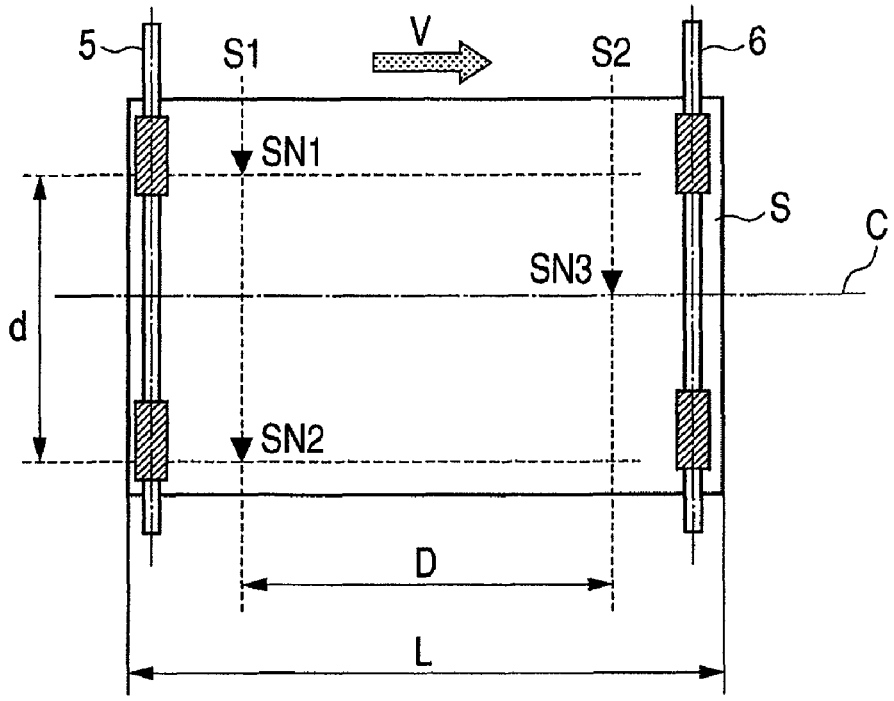
FIGS. 6A and 6B are plan views of first and second detecting units provided for a duplex conveying apparatus of a sheet conveying apparatus according to the second embodiment of the invention.

FIG. 6 is a plan view of first and second detecting units provided for the duplex conveying apparatus 502 of a sheet conveying apparatus according to such an embodiment. In FIG. 6, the same or corresponding portions as those in FIG. 2 mentioned above are designated by the same reference numerals.

As illustrated in FIG. 6, the two sheet detecting sensors SN1 and SN2 are arranged in the first detecting unit S1 so as to be symmetrical around the conveyance center C. One sensor SN3 is arranged in the second detecting unit S2 so as to be located on the conveyance center C.

The first and second detecting units S1 and S2 are arranged so as to be away from each other at the distance D in the sheet conveying direction. The two sheet detecting sensors SN1 and SN2 in the first detecting unit S1 are arranged at an interval of the distance d so as to be symmetrical around the conveyance center C.

Figure 7:
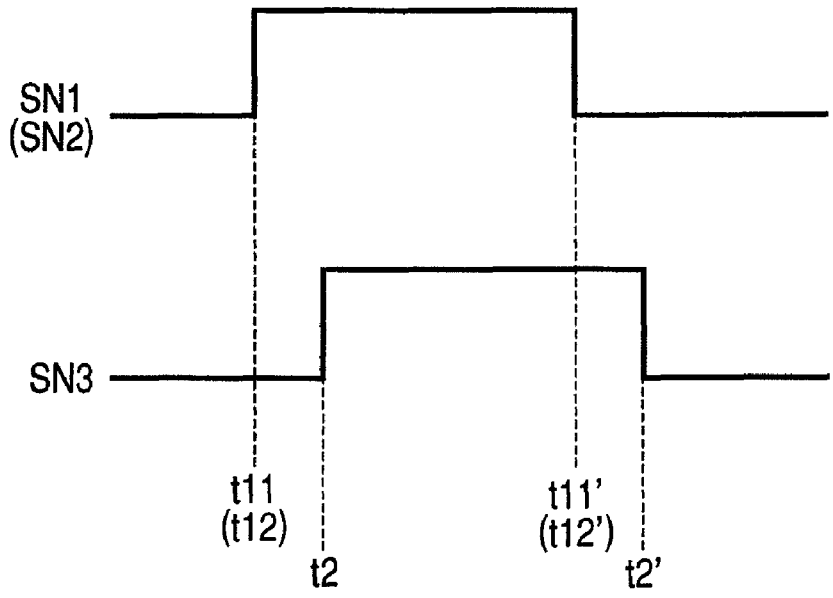
FIG. 7 is a diagram illustrating detection signals from three sheet detecting sensors provided for the two detecting units.

When the foregoing sheet feeding operation is started, detection signals as illustrated in FIG. 7 are derived from the sheet detecting sensors SN1 to SN3. In FIG. 7, t11 denotes the time when the leading edge of the sheet S has passed through the sheet detecting sensor SN1 of the first detecting unit S1, and t12 denotes the time when the leading edge of the sheet S has passed through the sheet detecting sensor SN2 of the first detecting unit S1.

t11' denotes the time when the trailing edge of the sheet S has passed through the sheet detecting sensor SN1, and t12' denotes the time when the trailing edge of the sheet S has passed through the sheet detecting sensor SN2. t2 denotes the time when the leading edge of the sheet S has passed through the sheet detecting sensor SN3 of the second detecting unit S2, and t2' denotes the time when the trailing edge of the sheet S has passed through the sheet detecting sensor SN3.

The average value of t11 and t12, that is, the timing when the leading edge of the sheet passes through the first detecting unit S1 as a first detecting position is assumed to be t1. The average value of t11' and t12', that is, the timing when the trailing edge of the sheet passes through the first detecting unit S1 as a first detecting position is assumed to be t1'. By calculating the average values as mentioned above, the value of the conveyance center C in which it is most difficult to receive the influence of the skew can be used.

In the above adjusting mode, the difference (t1'–t1) in the sensor signals at the time when the reference sheet having the known length L has passed through the first and second detecting units S1 and S2 is assumed to be $\alpha$. Likewise, (t2'–t2) is assumed to be $\beta$, (t2–t1) is assumed to be $\gamma$, and (t2'–t1') is assumed to be $\eta$. Further, the average value of $\alpha$ and $\beta$ is assumed to be Avg($\alpha$, $\beta$) and the average value of $\gamma$ and $\eta$ is assumed to be Avg($\gamma$, $\eta$).

The value of the reference distance D between the first and second detecting units S1 and S2 can be calculated by the average time Avg($\alpha$, $\beta$) during which the whole reference sheet passes, the average time Avg($\gamma$, $\eta$) during which the reference sheet passes between the first and second detecting units, and the foregoing equation (5).

The memory unit 9*b* stores the reference distance D obtained as mentioned above as an inherent value of every apparatus main body 100A in a manner similar to the foregoing first embodiment.

After that, when the sheet having the unknown length is conveyed, the arithmetic operations to detect the sheet conveying speed and the sheet length are executed by reading out the value of the reference distance stored in the memory unit 9*b* in a manner similar to the foregoing first embodiment.

As illustrated in FIG. 6, when the two sheet detecting sensors SN1 and SN2 are provided for the first detecting unit S1, the skew feed angle $\theta$ can be detected by the two sheet detecting sensors SN1 and SN2.

That is, in the second embodiment, unlike the first embodiment using the four sheet detecting sensors SN1 to SN4, the skew feed can be detected twice, that is, when the sheet S enters the first detecting unit S1 and when the sheet S exits from the first detecting unit S1. Even in the construction in which the number of times of the skew feed which can be detected is small, the invention can be also applied to an apparatus having a specification in which the image position precision of the recto and verso sides which is required is relatively low. Since one sensor can be saved, the costs can be reduced.

Figure 6B:
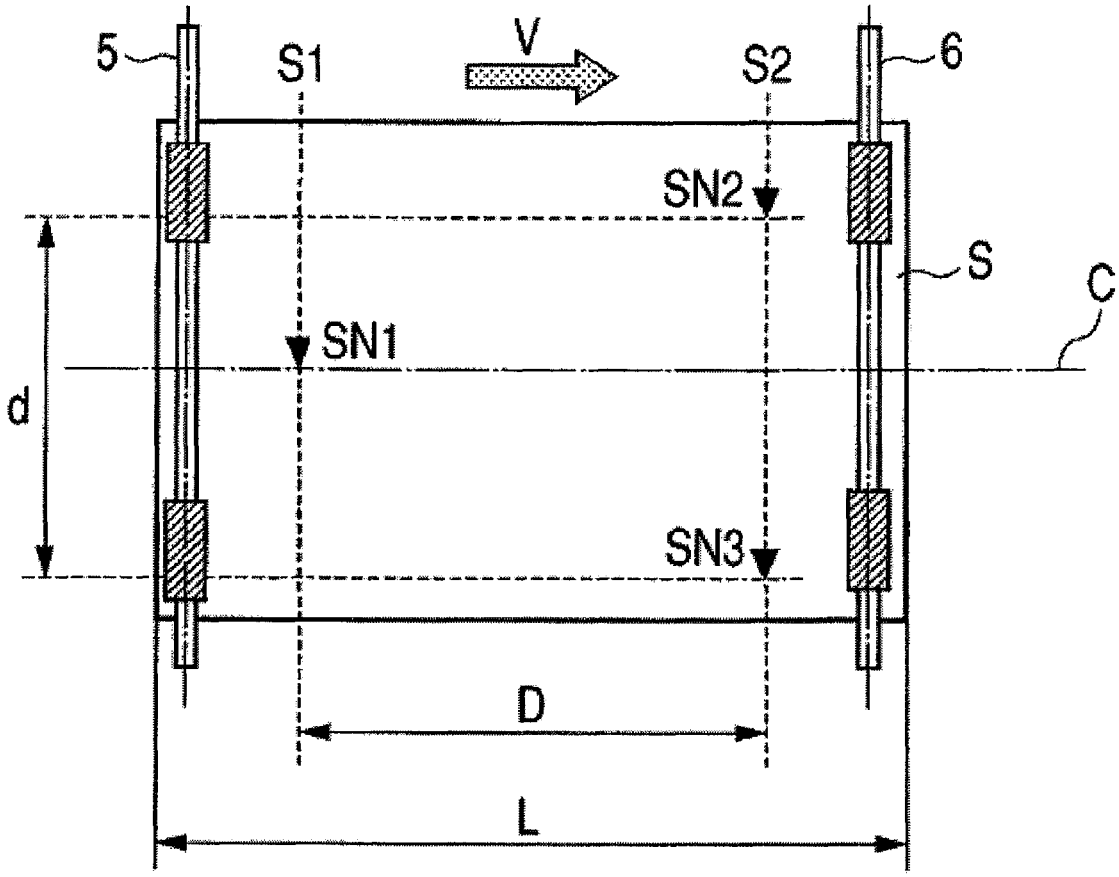

In the description so far, the two sensors SN1 and SN2 are arranged in the first detecting unit S1 so as to be symmetrical around the conveyance center C and the one sensor SN3 is arranged in the second detecting unit S2 so as to be located on the conveyance center C. However, as illustrated in FIG. 6B, the layout of the sensors may be reversed. That is, even if the one sensor SN1 is arranged in the first detecting unit S1 so as to be located on the conveyance center C and the two sheet detecting sensors SN2 and SN3 are arranged in the second detecting unit S2 at the interval of the distance d so as to be symmetrical around the conveyance center C, as shown in FIG. 6B, similar effects can be obtained.

Subsequently, the third embodiment of the invention will be described.

The first embodiment has been described above with respect to the construction using the four sheet detecting sensors and the second embodiment has been described above with respect to the construction using the three sheet detecting sensors. In the third embodiment, the reference distance is obtained by the two sheet detecting sensors.

Figure 8:
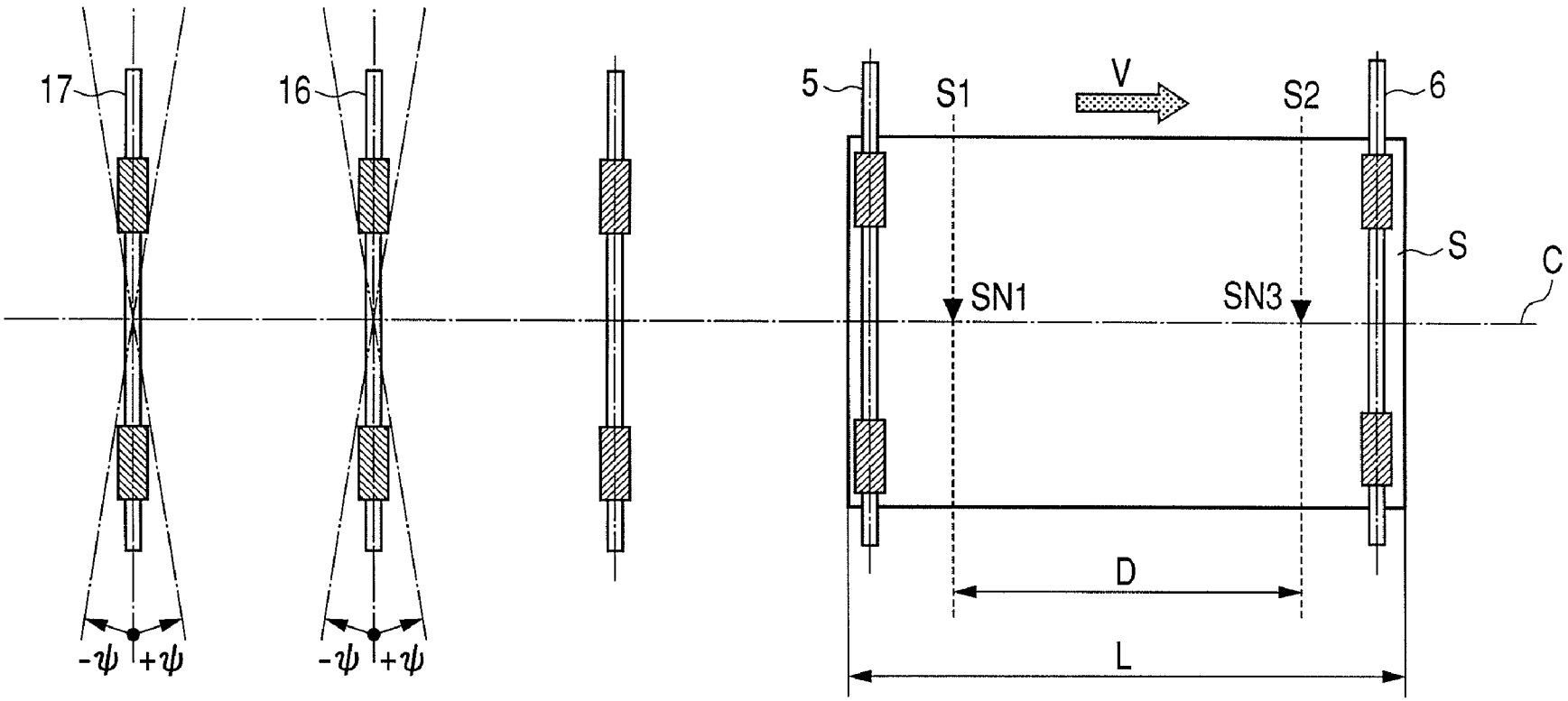
FIG. 8 is a plan view of first and second detecting units provided for a duplex conveying apparatus of a sheet conveying apparatus according to the third embodiment of the invention.

FIG. 8 is a plan view of the first and second detecting units provided for the duplex conveying apparatus 502 of a sheet conveying apparatus according to the third embodiment. In FIG. 8, the same or corresponding portions as those in FIG. 2 mentioned above are designated by the same reference numerals.

As illustrated in FIG. 8, the one sheet detecting sensor SN1 is arranged in the first detecting unit S1 so as to be located on the conveyance center C, and the one sheet detecting sensor SN3 is arranged in the second detecting unit S2 so as to be located on the conveyance center C.

The first and second detecting units S1 and S2 are arranged so as to be away from each other by the distance D in the sheet conveying direction. When the sheet feeding operation as mentioned above is started, detection signals as illustrated in FIG. 9 are derived from the sheet detecting sensors SN1 and SN3.

Figure 9:
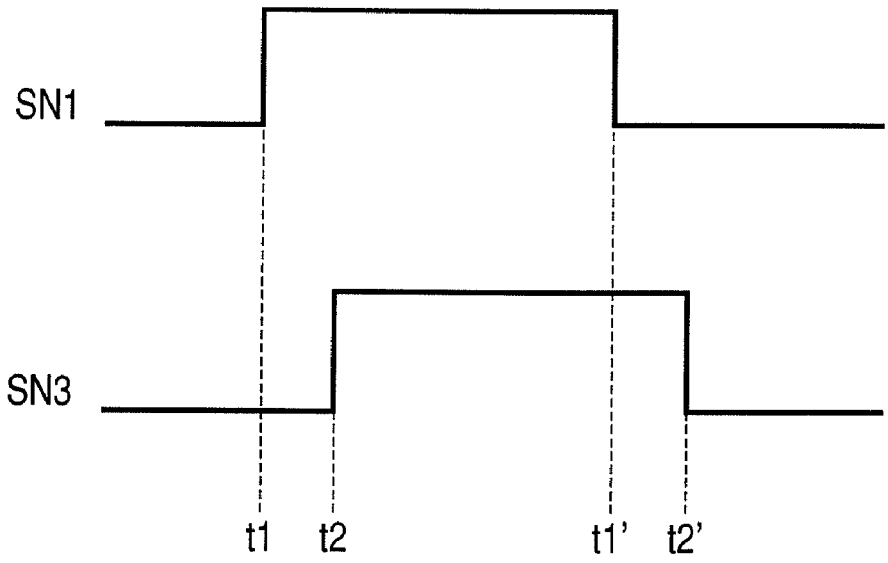
FIG. 9 is a diagram illustrating detection signals from two sheet detecting sensors provided for the two detecting units.

In FIG. 9, t1 denotes the leading edge passing time of the sheet detecting sensor SN1 of the first detecting unit S1, t2 denotes the leading edge passing time of the sheet detecting sensor SN3 of the second detecting unit S2, t1' denotes the trailing edge passing time of the sheet detecting sensor SN1, and t2' denotes the trailing edge passing time of the sheet detecting sensor SN3, respectively.

In the adjusting mode, the difference (t1'−t1) in the sensor signals at the time when the reference sheet having the known length L has passed through the first and second detecting units S1 and S2 is assumed to be $\alpha$. Likewise, (t2'−t2) is assumed to be $\beta$, (t2−t1) is assumed to be $\gamma$, and (t2'−t1') is assumed to be $\eta$. Further, the average value of $\alpha$ and $\beta$ is assumed to be Avg($\alpha$, $\beta$) and the average value of $\gamma$ and $\eta$ is assumed to be Avg($\gamma$, $\eta$).

The value of the reference distance D between the first and second detecting units S1 and S2 can be calculated by the average time Avg($\alpha$, $\beta$) during which the whole reference sheet passes, the average time Avg($\gamma$, $\eta$) during which the reference sheet passes between the first and second detecting units, and the foregoing equation (5). The memory unit 9*b* stores the reference distance obtained as mentioned above as an inherent value of every apparatus main body 100A in a manner similar to the foregoing first embodiment.

After that, when the sheet having the unknown length is conveyed, the arithmetic operations to detect the sheet conveying speed and the sheet length are executed by reading out the value of the reference distance D stored in the memory unit 9*b* in a manner similar to the foregoing first and second embodiments.

In the construction illustrated in FIG. 8, since the skew feed angle $\theta$ cannot be detected in the first and second detecting units S1 and S2, a device for correcting the skew feed of the sheet S before the sheet enters the first detecting unit S1 is necessary.

In the embodiment, therefore, as illustrated in FIG. 8, the apparatus is constructed in such a manner that an alignment of at least one of a group of conveying rollers arranged in the upstream of the blast roller 5, for example, a conveying roller 16 can be adjusted. In the conveying roller 16, a driven roller is supported to a driving roller (not shown) so as to be movable within an angle range of $\pm\psi$ as illustrated in the diagram.

Specifically speaking, the skew feed is corrected by, for example, deciding a specific alignment adjustment angle $\psi$ in consideration of a skew feed situation of a test print. If the skew feed correcting ability is inadequate when the alignment adjustment of only one conveying roller 16 is performed, it is sufficient to increase the number of skew feed correcting positions by providing a similar construction with respect to a conveying roller 17 locating in the further upstream, or the like.

In the case of obtaining the reference distance, it is desirable to arrange the conveying roller 16 in such a manner that the trailing edge of the reference sheet exists completely from the conveying roller 16 at a point of time when the leading edge of the reference sheet has entered the first detecting unit S1.

The fourth embodiment of the invention will now be described.

Figure 10:
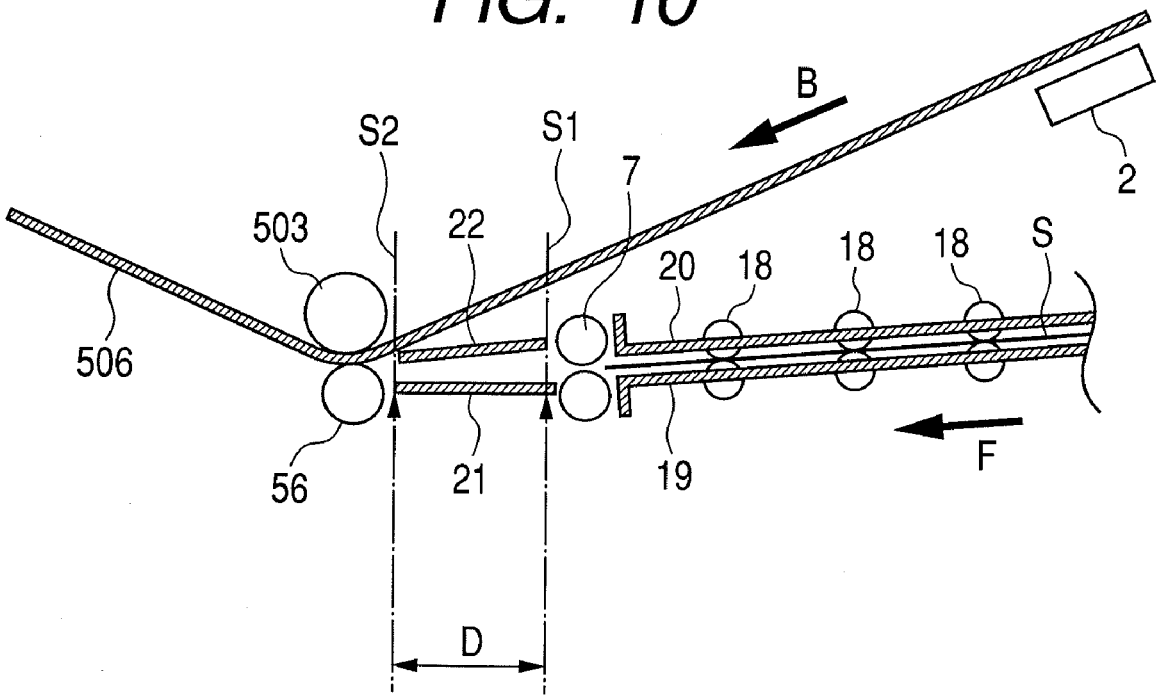
FIG. 10 is an enlarged diagram of an interval from a registration roller to a secondary transfer unit in a sheet conveying apparatus according to the fourth embodiment of the invention.

FIG. 10 is an enlarged diagram of an interval from the registration roller 7 to a secondary transfer unit in a sheet conveying apparatus according to the fourth embodiment.

In FIG. 10, upper and lower conveying guides 20 and 19 are provided in the upstream of the registration roller 7. A lower pre-transfer guide 21 and an upper pre-transfer guide 22 are provided between the registration roller 7 and the secondary transfer unit in order to stabilize the conveying motion of the sheet S.

The sheet S is conveyed in a conveying path formed by the upper and lower conveying guides 20 and 19 in the direction shown by an arrow F by a plurality of conveying roller pairs 18 and reaches the registration roller 7. After that, the sheet is conveyed to the secondary transfer unit by the registration roller 7. In order to correct the skew feed, the conveying roller pairs 18 may be replaced by skew feed rollers or the like which have been supported obliquely to the conveying direction.

In the embodiment, the first detecting unit S1 is arranged on the downstream side in the sheet conveying direction of the registration roller 7 and the second detecting unit S2 is arranged at a position just before the secondary transfer unit on the downstream side of the first detecting unit S1. The first and second detecting units S1 and S2 are arranged so as to be away from each other at the distance D in the sheet conveying direction. The sheet detecting sensor for detecting the passing timing of the sheet S is provided for each of the first and second detecting units S1 and S2.

In the embodiment, in order to improve the mass-productivity, the sheet S is conveyed to the secondary transfer unit at a speed higher than a processing speed. In the case of conveying the sheet S to the secondary transfer unit at the speed higher than the processing speed, a rotational speed of a driving motor (not shown) of the registration roller 7 is reduced, thereby decelerating the sheet S down to the processing speed before the sheet S reaches the secondary transfer unit.

In the embodiment, in order to precisely transfer the toner image to a desired position on the sheet S, a leading edge patch image (not shown) has been formed on the intermediate transfer belt 506. By detecting the leading edge patch image by a patch detecting sensor 2, the timing when the sheet S reaches the secondary transfer unit is controlled.

Figure 11A:
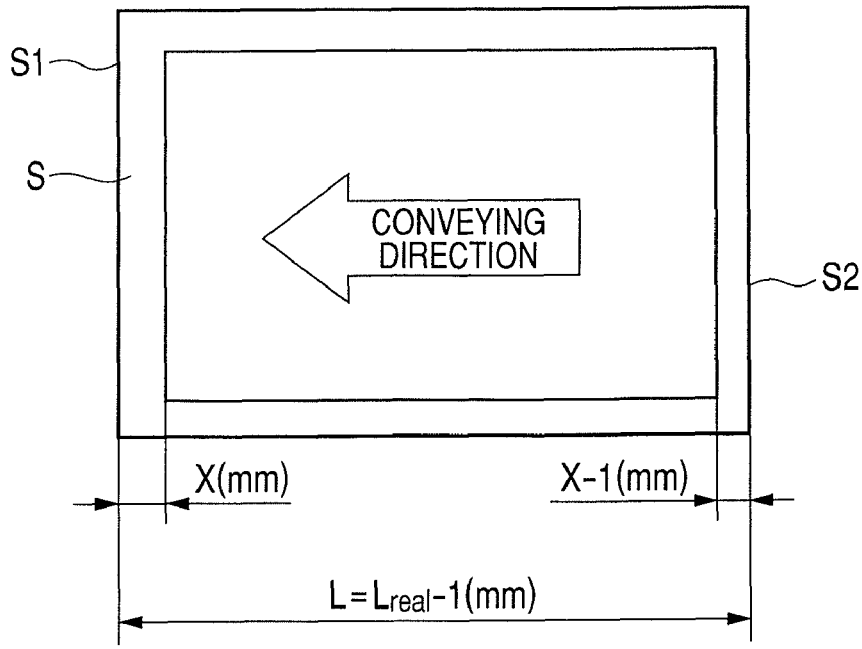
FIG. 11A is a diagram for describing a positioning of an image and is a diagram illustrating an image position on a first surface (recto side).
Figure 11B:
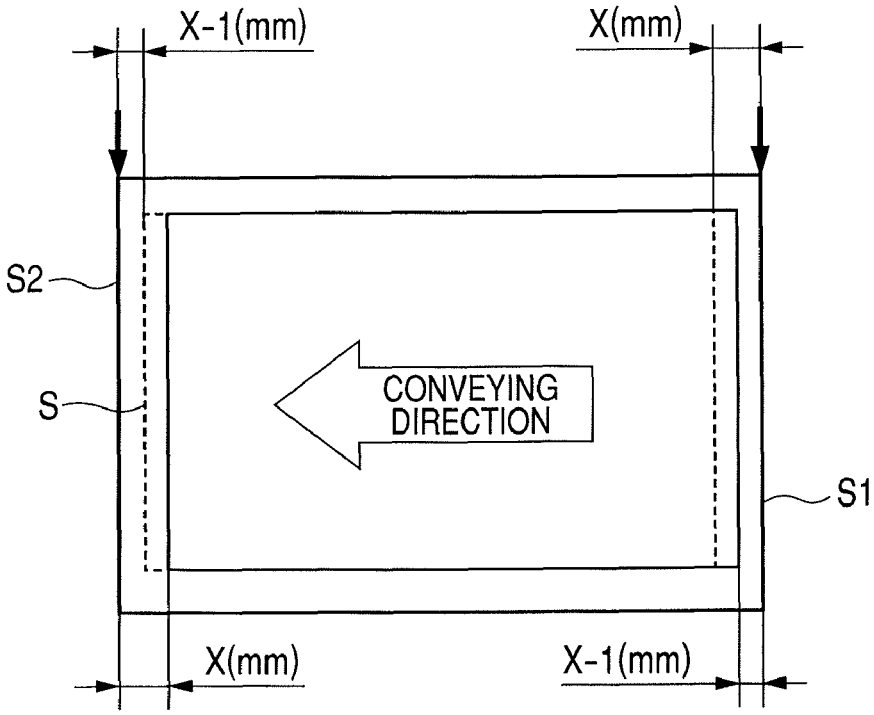
FIG. 11B is a diagram for describing a positioning of an image and is a diagram illustrating an image position on a second surface (verso side).

The timing for decelerating the registration roller 7 is decided according to the sheet length. Subsequently, a method of deciding the decelerating timing for the registration roller 7 based on the sheet length as mentioned above will be described with reference to FIGS. 11A and 11B. FIGS. 11A and 11B are illustrated by presuming a case where the sheet S having a nominal size of $L_{real}$ has been cut at a size which is shorter by 1 mm, that is, on the assumption that the sheet length $L=L_{real}-1$ mm.

FIG. 11A illustrates the image position on the first surface (recto side) and FIG. 11B illustrates the image position on the second surface (verso side). For simplicity of description, it is assumed here that a contraction/expansion change in length L and a change in image magnification due to the temperature and moisture do not occur and the image size is determined so that blank amounts of the leading edge and the trailing edge are fundamentally equalized.

As illustrated in FIG. 11A, when the image on the first surface (recto side) shown by a solid line is formed (transferred) onto the sheet S which is conveyed in the arrow direction in a state where the image has a leading edge blank of X mm, a trailing edge blank is equal to (X−1) mm because it lacks by 1 mm. The image on the first surface (recto side) is now formed based on a leading edge S1 as a reference.

Subsequently, the sheet S is conveyed toward the secondary transfer unit in order to form the image on the second surface (verso side). At this time, the sheet S is conveyed in a state where the leading edge and the trailing edge are exchanged by the switch-back operation. Therefore, when the image is formed onto the second surface (verso side), as illustrated in FIG. 11B, the leading edge S1 is located at the trailing edge in the sheet conveying direction and a trailing edge S2 is located at the leading edge.

Now, assuming that the decelerating timing for the registration roller 7 is controlled by a same time $T_{reg}$ as that in the case of the first surface, the image on the second surface (verso side) shown by a solid line is formed (transferred) onto the sheet so as to have a blank of X mm from the trailing edge S2. However, in the case of controlling as mentioned above, an recto/verso positional deviation of 1 mm occurs between the first surface (recto side) image shown by a broken line and the blank (X−1) mm of the trailing edge S2.

However, if the sheet length has been detected in the conveying path, that is, if the sheet length information of ($L=L_{real}-1$ mm) has been obtained, by shifting the second surface (verso side) image toward the trailing edge S2 side by 1 mm as a difference from the nominal size, the recto/verso positional deviation can be reduced. In this case, since it is sufficient to relatively delay the sheet S, it is desirable that the decelerating timing for the registration roller is set to be earlier than the nominal time $T_{reg}$ reg by a time $\Delta T_{reg}$ corresponding to 1 mm.

However, the time $T_{reg}$ during which the nominal decelerating timing is controlled is a set value based on the nominal dimensions of the distance D between the first and second detecting units S1 and S2 illustrated in FIG. 10. Therefore, if the distance D varies from the nominal dimensions due to the mechanical tolerance or the like of the component parts, such a situation appears as an inherent timing deviation which differs every apparatus by the time corresponding to a difference between the nominal dimensions and the actual dimensions.

In the embodiment, therefore, the technique regarding the image positional precision of the recto and verse sides provides the desired effect and in order to finally improve the quality of the printed material, the value of the distance D between the first and second detecting units S1 and S2 is accurately obtained and stored as an inherent value.

First, as described in the foregoing first to third embodiments, the adjusting mode of the distance D is executed from the display screen of the operating unit 71 of the color image forming apparatus 100. That is, the operation for feeding out the adjusting reference sheet having the known length from the sheet feeding unit 100B toward the first and second detecting units S1 and S2 illustrated in FIG. 10 is executed.

The foregoing deceleration control of the registration roller 7 is made at the operation in the normal print mode. At the operation in the adjusting mode, the registration roller 7 is driven by the same sheet conveying speed settings as those of the upstream conveying roller pairs 18 and the downstream secondary transfer inner roller 503 and secondary transfer outer roller 56 and is not deceleration-controlled.

This is because the influence of the speed fluctuation is not exercised on the four detection signals α, β, γ, and η as described in the foregoing first to third embodiments. Thus, the distance D between the first and second detecting units S1 and S2 can be accurately and easily obtained from the equation (5) mentioned above. The value of the reference distance obtained in the adjusting mode is stored into the memory unit. When the decelerating timing for the registration roller 7 is determined in the subsequent print mode, the reference distance is certainly read out and the arithmetic operations are executed.

The number of sheet detecting sensors which are arranged in the first and second detecting units S1 and S2 is set to any one of the values in the foregoing first to third embodiments, that is, 2 to 4. The processing method of the detection signal of each sheet detecting sensor is also as described in the foregoing first to third embodiments. Although the secondary transfer construction using the intermediate transfer belt has been mentioned as an example in FIG. 10, particularly, another construction may be used so long as it is a portion adapted to transfer the image onto the sheet S.

The fifth embodiment of the invention will now be described.

Figure 12:
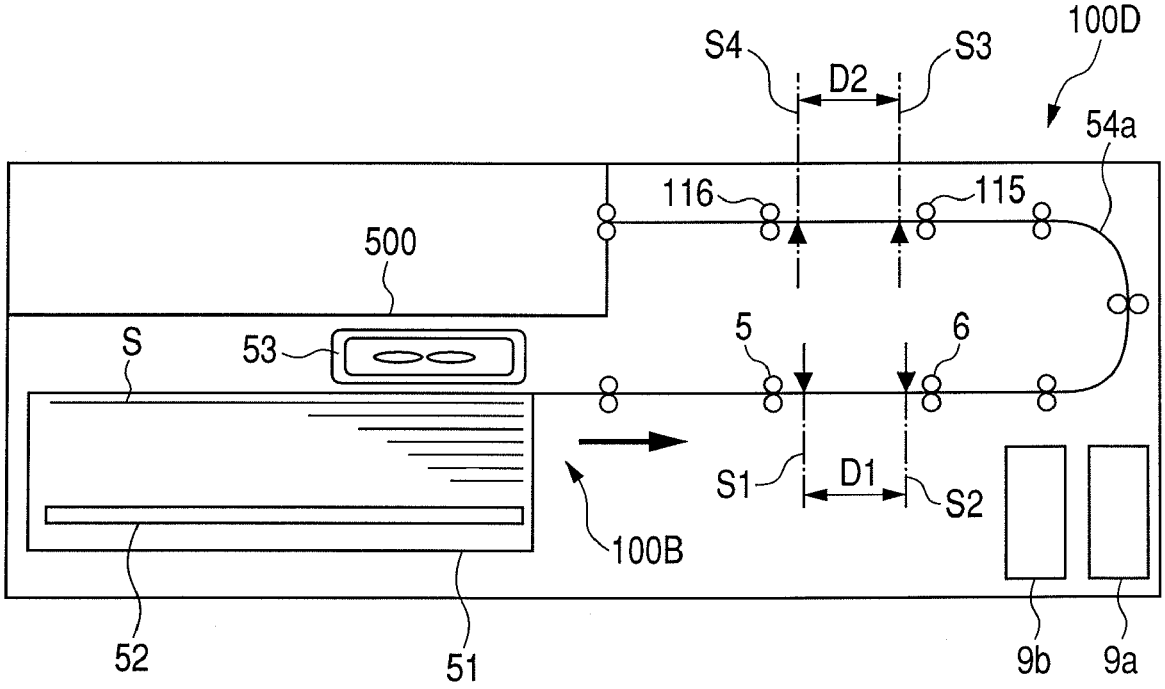
FIG. 12 is a diagram for describing a construction of a sheet conveying apparatus according to the fifth embodiment of the invention.

FIG. 12 is a diagram for describing a construction of a sheet conveying apparatus according to the fifth embodiment. In FIG. 12, the same or corresponding portions as those in FIG. 1 mentioned above are designated by the same reference numerals.

In FIG. 12, third and fourth detecting units S3 and S4 are arranged on the downstream side of the first and second detecting units S1 and S2. In the embodiment, a distance between the first and second detecting units S1 and S2 is assumed to be D1 and a distance between the third and fourth detecting units S3 and S4 is assumed to be D2. Those detecting units are provided as inspection systems for detecting a mark (for example, forgery preventing unit such as a hologram or the like) which have previously been printed on the sheet.

In FIG. 12, the conveying rollers 5 and 6 are arranged in the upstream and downstream of the first and second detecting units S1 and S2. Conveying rollers 115 and 116 are arranged in the upstream and downstream of the third and fourth detecting units S3 and S4. Blast rollers are used as those conveying rollers 5, 6, 115, and 116.

Figure 13A:
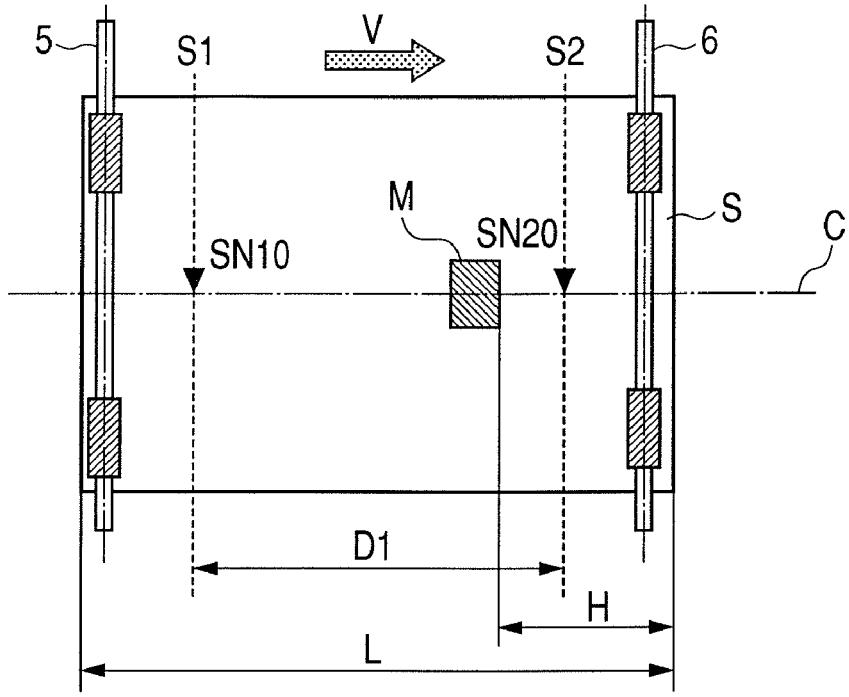
FIG. 13A is a plan view of first and second detecting units provided for the sheet conveying apparatus according to the fifth embodiment of the invention.
Figure 13B:
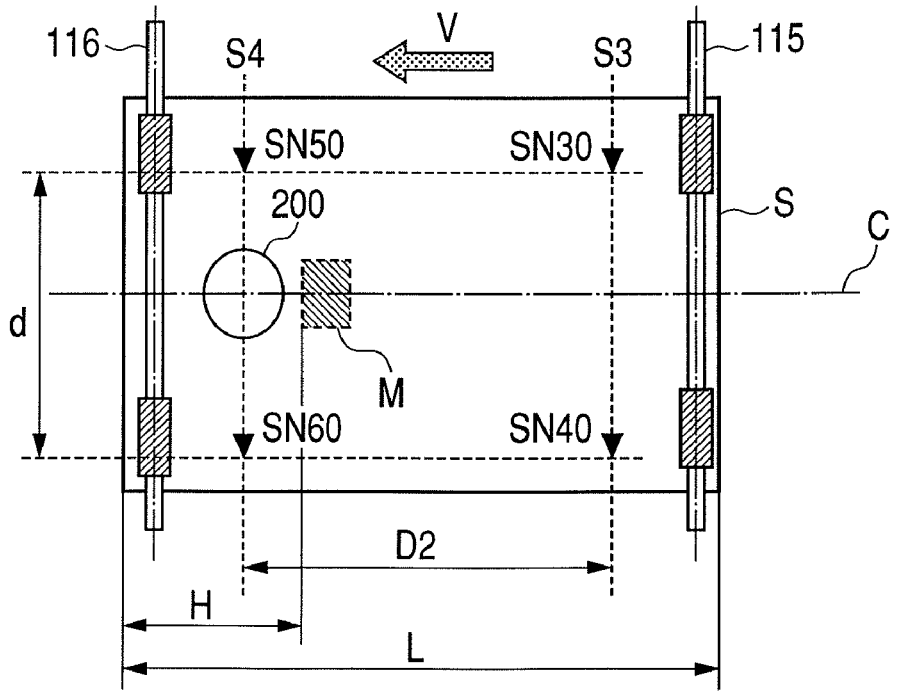
FIG. 13B is a plan view of third and fourth detecting units provided for the sheet conveying apparatus according to the fifth embodiment of the invention.

As illustrated in FIGS. 13A and 13B, on the sheet S which is conveyed in the arrow direction at the speed V, a mark M has previously been printed at a position of H from the leading edge on the conveyance center C. As illustrated in FIG. 13A, sensors SN10 and SN20 for detecting the mark M are provided for the first and second detecting units S1 and S2 so as to be located on the conveyance center C.

As illustrated in FIG. 13B, sensors SN30 and SN40 are provided for the third detecting unit S3 at the interval of the distance d so as to be symmetrical around the conveyance center C, and sensors SN50 and SN60 are likewise provided for the fourth detecting unit S4 at the interval of the distance d so as to be symmetrical around the conveyance center C. The sensors SN10 and SN20 are sensors which can detect the leading/trailing edges of the sheet and the leading/trailing edges of the mark M, respectively.

A camera 200 for photographing the mark M is provided for the fourth detecting unit S4 so as to be located on the conveyance center C. The mark M photographed by the camera 200 is collated with an image processing apparatus or the like (not shown), thereby discriminating about the truth or falsehood. After the sheet was fed, since the sheet S passes through the conveying path 54*a*, the top and bottom of the sheet are replaced. In FIGS. 13A and 13B, the marks M are located on the opposite surfaces of the sheet S.

Figure 14:
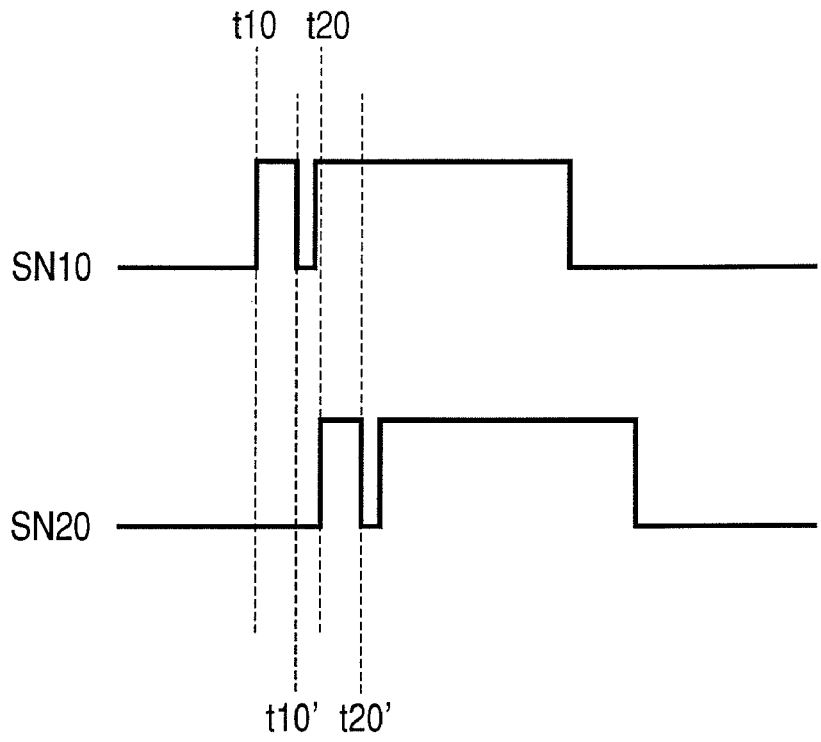
FIG. 14 is a diagram illustrating detection signals from two sheet detecting sensors provided for the first and second detecting units.
Figure 15:
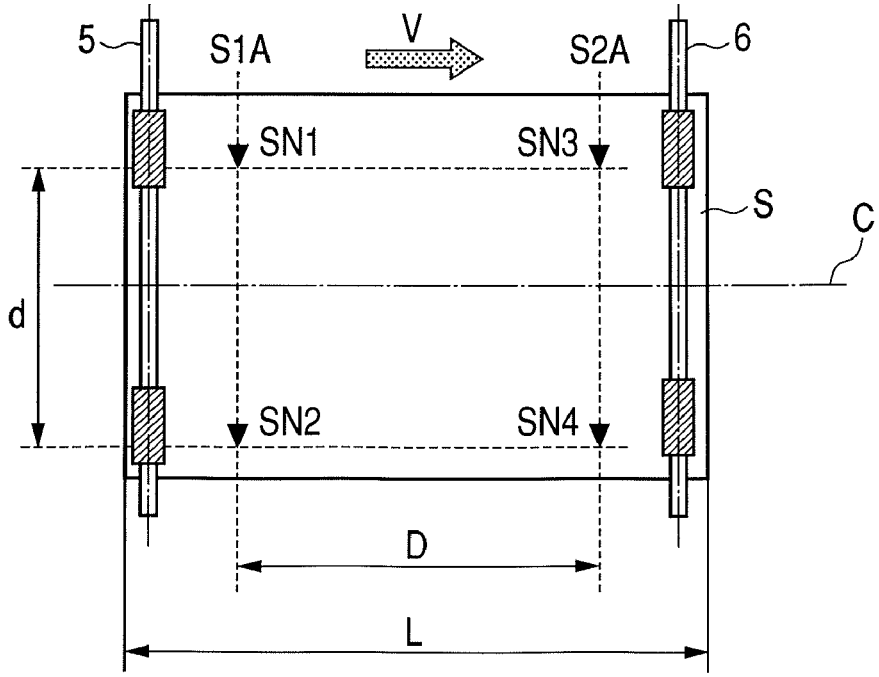
FIG. 15 is a plan view of two detecting units provided for a sheet conveying apparatus in a related art.
Figure 16:
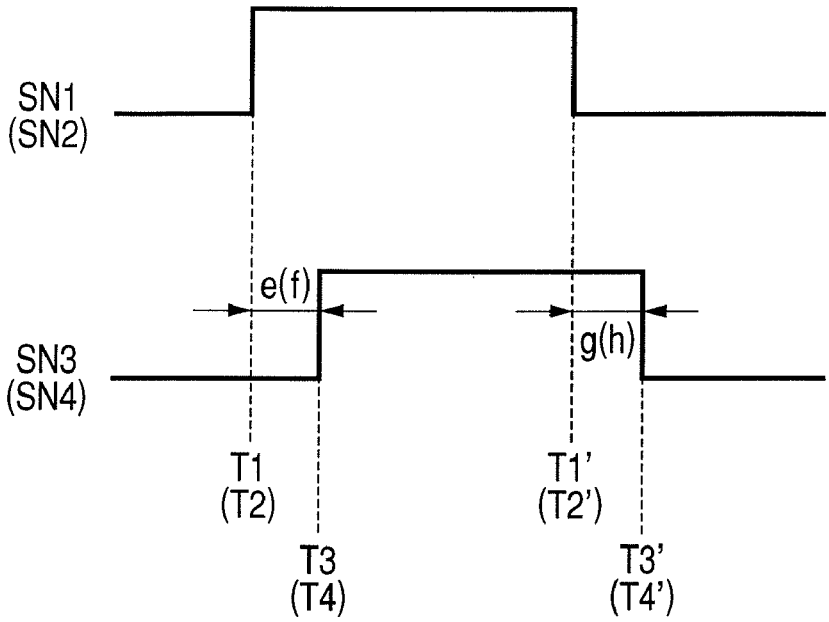
FIG. 16 is a diagram illustrating detection signals from four sheet detecting sensors provided for the two detecting units.

Subsequently, the control operation for detecting the mark M will be described. FIG. 14 illustrates detection signals from the sensors SN10 and SN20 at the time when the sheet S has passed through the first and second detecting units S and S2. A time lag corresponding to the distance D1 occurs between the sensors SN10 and SN20.

In FIG. 14, t10 denotes a time when the leading edge of the sheet has passed through the sensor SN10 of the first detecting unit S1, t20 denotes a time when the leading edge of the sheet has passed through the sensor SN20 of the second detecting unit S2, t10' denotes a time when the leading edge of the mark M has passed through the sensor SN10, and t20' denotes a time when the leading edge of the mark M has passed through the sensor SN20. That is, when the mark M passes through the sensors SN10 and SN20, the sensors SN10 and SN20 are turned off from the ON state.

A difference [t10'–t10] between the sensor signals at the time when the sheet has passed through the first and second detecting units S1 and S2 is assumed to be α. Likewise, [t20'–t20] is assumed to be β, [t20–t10] is assumed to be γ, and [t20'–t10'] is assumed to be η. The average value of γ and β is assumed to be Avg(α, β) and the average value of γ and η is assumed to be Avg(γ, η).

The sheet conveying speed and a distance H between the leading edge of the mark M and the leading edge of the sheet can be obtained by the following equations (6) and (7) from the obtained average time Avg(α, β) during which the mark M passes and the obtained average time Avg(γ, η) during which the sheet passes through the first and second detecting units.

$$V=D1/\mathrm{Avg}(\gamma,\eta) \tag{6}$$

$$H=V\times\mathrm{Avg}(\alpha,\beta) \tag{7}$$

If the value of H is known from the equation (7), a time $T_H$ during which the sheet reaches the fourth detecting unit S4 can be obtained by the following equation (8) at a point of time when the leading edge of the sheet S has been detected by the third detecting unit S3.

$$T_H=(D2+H)/V \tag{8}$$

Based on the information of the time $T_H$ obtained as mentioned above, the mark M can be accurately stopped according to the position of the camera 200 provided for the fourth detecting unit S4.

That is, by accurately knowing the value of H included in the equation (8), the time deviation corresponding to a difference between a nominal value of H and the actual value of H obtained by the equation (7) can be accurately controlled.

However, the control operation described above is based on such a presumption that the distances D1 and D2 are obtained according to design nominal values as they are. Actually, the distances D1 and D2 are different from the design nominal values and vary due to the mechanical tolerance of the component parts.

If the errors are included in the values of the distances D1 and D2 as mentioned above, the sheet conveying speed V shown in the equation (6) is erroneously estimated, so that the position H of the mark M is also recognized at a position deviated from the actual position. Further, since the equation (8) includes therein the D2 containing the error in addition to the deviated position H, a larger amount of errors have been accumulated in the arrival time $T_H$ to the fourth detecting unit S4.

Therefore, in order to allow the control operation based on the above equations (6) to (8) to be correctly executed, it is necessary to accurately grasp the values of the distances D1 and D2 which differ every apparatus. For this purpose, therefore, in the embodiment, the values of the distances D1 and D2 are accurately obtained and stored as inherent values.

Therefore, the adjusting mode of the distance D is started from the display screen of the operating unit 71 as described in any one of the foregoing first to third embodiments. In this case, the operations for feeding the adjusting reference sheet having the known length and ejecting it onto the discharge tray 500 are executed. In the normal sheet conveying operation, although the stop control for detecting the mark M is made in the fourth detecting unit S4, at the time of the operation in the adjusting mode, the sheet is conveyed at a constant speed without executing the acceleration or deceleration and the stop control.

This is because it is necessary to prevent that the speed fluctuation exerts an influence on the four detection signals α, β, γ, and η as described in the foregoing first to fourth embodiments. Thus, the reference distance can be accurately and easily obtained from the foregoing equation (5).

With respect to the reference sheet S which is used in the adjusting mode, it is not always necessary that it has the same size as that of the sheet which is particularly actually used so long as the sheet length L has previously been known. The mark M is also unnecessary for the reference sheet. As mentioned above, the distance obtained from the adjusting mode is stored as a reference distance peculiar to the apparatus into the memory unit 9*b* held in the sheet conveying apparatus. At the time of the arithmetic operations of the equations (6) to (8) regarding the subsequent control operation, the values of the reference distances D1 and D2 read out of the storing unit 9*b* are certainly used and processed in the arithmetic operating unit 9*a*.

The number of sensors arranged in the first to fourth detecting units S1 to S4 is not limited to the values shown in FIGS. 12 to 13B but any one of the constructions illustrated in the first to third embodiments may be selected and used. The sheet conveying apparatus as illustrated in FIG. 12 may be replaced by another sheet conveying apparatus having functions other than the inspecting function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-199852, filed Jul. 31, 2007, which is hereby incorporated by reference herein in its entirety.

What is claimed is:

1. A sheet conveying apparatus comprising:

a first detecting unit that detects a conveyed sheet at a first detecting position;

a second detecting unit that detects the conveyed sheet at a second detecting position provided on a downstream in a sheet conveying direction of the first detecting position;

a calculation unit that calculates a distance between the first detecting position and the second detecting position based on a time from when a leading edge of the reference sheet is detected by one of the first detecting unit and the second detecting unit until when a trailing edge of the reference sheet is detected by said one of the first detecting unit and the second detecting unit, a time from when one of the leading edge of the reference sheet and the trailing edge of the reference sheet is detected by the first detection unit until when said one of the leading edge of the reference sheet and the trailing edge of the reference sheet is detected by the second detection unit, and the length of the reference sheet.

2. A sheet conveying apparatus according to claim 1, wherein each of the first detecting unit and the second detecting unit has a plurality of sheet detecting units arranged at positions which are symmetrical around a center in a lateral direction that perpendicularly crosses the sheet conveying direction of a sheet conveying path, and a detection signal from the first detecting unit is an average value of detection signals from the plurality of sheet detecting units at the time when the reference sheet has passed through the first detecting unit, and a detection signal from the second detecting unit is an average value of detection signals from the plurality of sheet detecting units at the time when the reference sheet has passed through the second detecting unit.

3. A sheet conveying apparatus according to claim 2, wherein a skew feed of the sheet is detected based on the detection signals from the plurality of sheet detecting units.

4. A sheet conveying apparatus according to claim 1, wherein the first detecting unit has a plurality of sheet detecting units arranged at positions which are symmetrical around a center in a lateral direction that perpendicularly crosses the sheet conveying direction of a sheet conveying path, the second detecting unit has one sheet detecting unit arranged at the center in the lateral direction of the sheet conveying path, and a detecting signal from the first detecting unit is an average value of detection signals from the plurality of sheet detecting units at the time when the reference sheet has passed through the first detecting unit, and a detection signal from the second detecting unit is a detection signal from the one sheet detecting unit at the time when the reference sheet has passed through the second detecting unit.

5. A sheet conveying apparatus according to claim 1, wherein the first detecting unit has one sheet detecting unit arranged at a center in a lateral direction of a sheet conveying path, the second detecting unit has a plurality of sheet detecting units arranged at positions which are symmetrical around the center in the lateral direction of the sheet conveying path, and a detection signal from the first detecting unit is a detection signal from the one sheet detecting unit at the time when the reference sheet has passed through the first detecting unit, and a detection signal from the second detecting unit is an average value of detection signals from the plurality of sheet detecting units at the time when the reference sheet has passed through the second detecting unit.

6. A sheet conveying apparatus according to claim 1, wherein each of the first detecting unit and the second detecting unit has one sheet detecting unit arranged at a center in a lateral direction of a sheet conveying path, and a detection signal from the first detecting unit is a detection signal from the one sheet detecting unit at the time when the reference sheet has passed through the first detecting unit, and a detection signals from the second detecting unit are detection signals from the one sheet detecting unit at the time when a leading edge and a trailing edge of the reference sheet have passed through the second detecting unit.

7. A sheet conveying apparatus according to claim 1, wherein the detection signals from the first detecting unit correspond to a time when a leading edge and a trailing edge of the reference sheet have passed through the first detecting unit, and detection signals from the second detecting unit correspond to a time when the leading edge and the trailing edge of the reference sheet have passed through the second detecting unit.

8. A sheet conveying apparatus according to claim 1, further comprising a storing unit that stores the distance which has been calculated by the calculation unit, wherein the calculation unit calculates at least either a conveying speed of the sheet or a length in the conveying direction of the sheet based on detection signals from the first detecting unit and the second detecting unit at time when the sheet is conveyed and the distance stored in the storing unit.

9. A sheet conveying apparatus according to claim 8, wherein the calculation unit calculates timing for stopping the sheet based on the sheet conveying speed and the sheet length which have been operated at the time when a mark formed on the sheet has reached a predetermined position.

10. A sheet conveying apparatus according to claim 1, wherein the calculation unit obtains a conveying speed of the reference sheet based on detection signals from the first detecting unit and the second detecting unit at the time when the reference sheet is conveyed and the length of the reference sheet, and calculates the distance from the obtained conveying speed and the detection signals from the first detecting unit and the second detecting unit at the time when the reference sheet is conveyed.

11. A sheet conveying apparatus according to claim 1, further comprising a setting unit for setting the length of the reference sheet.

12. An image forming apparatus comprising:

an image forming unit configured to form an image onto a sheet;

the sheet conveying apparatus according to claim 1 configured to convey the sheet on which the image is formed by the image forming unit;

a duplex conveying path which is provided for the sheet conveying apparatus and is configured to convey the sheet to the image forming unit again in order to form an image onto a second surface of the sheet in which the image has been formed on a first surface by the image forming unit; and a storing unit that stores the distance which has been calculated by the calculation unit, wherein the calculation unit calculates the length in the conveying direction of the sheet which is conveyed on the duplex conveying path based on detection signals from the first detecting unit and the second detecting unit and the distance stored in the storing unit, and a position of the image on the sheet at the time when the image forming unit forms the image onto the second surface of the sheet is adjusted based on the sheet length which has been operated by the calculation unit.

13. A sheet conveying apparatus comprising:

a first detecting unit that detects a conveyed sheet at a first detecting position;

a second detecting unit that detects the conveyed sheet at a second detecting position provided downstream in a sheet conveying direction from the first detecting position; and a calculation unit that calculates a distance D between the first detecting position and the second detecting position, wherein said distance D is calculated as follows:

$$D=L*T2/T1$$

where T1 is an average value of a time from when a leading edge of a reference sheet, having a known length in the sheet conveying direction, is detected by the first detecting unit till when a trailing edge of the reference sheet is detected by the first detecting unit and a time from when the leading edge of the reference sheet is detected by the second detecting unit till when the trailing edge of the reference sheet is detected by the second detecting unit, T2 is an average value of a time from when the leading edge of the reference sheet is detected by the first detection unit till when the leading edge of the reference sheet is detected by the second detection unit and a time from when the trailing edge of the reference sheet is detected by the first detection unit till when the trailing edge of the reference sheet is detected by the second detection unit, and L is the length of the reference sheet.

14. A sheet conveying apparatus according to claim 13, further comprising a setting unit for setting the length of the reference sheet.

15. A sheet conveying apparatus according to claim 13, wherein each of the first detecting unit and the second detecting unit has a plurality of sheet detecting units arranged at positions which are symmetrical around a center in a lateral direction that perpendicularly crosses the sheet conveying direction of a sheet conveying path, and a detecting signal from the first detecting unit is an average value of detection signals from the plurality of sheet detecting units at the time when the reference sheet has passed through the first detecting unit, and a detection signal from the second detecting unit is an average value of detection signals from the plurality of sheet detecting units at the time when the reference sheet has passed through the second detecting unit.

16. A sheet conveying apparatus according to claim 13, wherein the first detecting unit has a plurality of sheet detecting units arranged at positions which are symmetrical around a center in a lateral direction that perpendicularly crosses the sheet conveying direction of a sheet conveying path, the second detecting unit has one sheet detecting unit arranged at the center in the lateral direction of the sheet conveying path, and a detection signal from the first detecting unit is an average value of detection signals from the plurality of sheet detecting units at the time when the reference sheet has passed through the first detecting unit, and a detection signal from the second detecting unit is a detection signal from the one sheet detecting unit at the time when the reference sheet has passed through the second detecting unit.

17. A sheet conveying apparatus according to claim 13, wherein the first detecting unit has one sheet detecting unit arranged at a center in a lateral direction of a sheet conveying path, the second detecting unit has a plurality of sheet detecting units arranged at positions which are symmetrical around the center in the lateral direction of the sheet conveying path, and a detection signal from the first detecting unit is a detection signal from the one sheet detecting unit at the time when the reference sheet has passed through the first detecting unit, and a detection signal from the second detecting unit is an average value of detection signals from the plurality of sheet detecting units at the time when the reference sheet has passed through the second detecting unit.

18. A sheet conveying apparatus according to claim 13, wherein each of the first detecting unit and the second detecting unit has one sheet detecting unit arranged at a center in a lateral direction of a sheet conveying path, and a detection signal from the first detecting unit is a detection signal from the one sheet detecting unit at the time when the reference sheet has passed through the first detecting unit, and detection signals from the second detecting unit are detection signals from the one sheet detecting unit at the time when a leading edge and a trailing edge of the reference sheet have passed through the second detecting unit.

19. A sheet conveying apparatus according to claim 13, further comprising a storing unit that stores the distance which has been calculated by the calculation unit, wherein the calculation unit calculates at least either a conveying speed of the sheet or a length in the conveying direction of the sheet based on detection signals from the first detecting unit and the second detecting unit.

20. An image forming apparatus comprising:

an image forming unit configured to form an image onto a sheet;

the sheet conveying apparatus according to claim 13 configured to convey the sheet on which the image is formed by the image forming unit;

a duplex conveying path which is provided for the sheet conveying apparatus and is configured to convey the sheet to the image forming unit again in order to form an image onto a second surface of the sheet in which the image has been formed on a first surface by the image forming unit; and a storing unit that stores the distance which has been calculated by the calculation unit, wherein the calculation unit calculates the length in the conveying direction of the sheet which is conveyed on the duplex conveying path based on detection signals from the first detecting unit and the second detecting unit and the distance stored in the storing unit, and a position of the image on the sheet at the time when the image forming unit forms the image onto the second surface of the sheet is adjusted based on the sheet length which has been operated by the calculation unit.

21. A method for a sheet conveying apparatus having a first detecting unit that detects a conveyed sheet at the first detecting position, and a second detecting unit that detects the conveyed sheet at a second detecting position provided on a downstream in a sheet conveying direction of the first position, the method of detecting a distance of the first detecting position and the second detecting position comprising the steps of:

conveying a reference sheet whose length in the sheet conveying direction has already been known;

detecting the conveyed reference sheet by the first detecting unit and the second detecting unit;

calculating the distance based on a time from when a leading edge of the reference sheet is detected by one of the first detecting unit and the second detecting unit until when a trailing edge of the reference sheet is detected by said one of the first detecting unit and the second detecting unit, a time from when one of the leading edge of the reference sheet and the trailing edge of the reference sheet is detected by the first detection unit until when said one of the leading edge of the reference sheet and the trailing edge of the reference sheet is detected by the second detection unit, and the length of the reference sheet.

22. A method according to claim 21 further comprising the step:

setting the length of the reference sheet.

* * * * *